US011306550B2

(12) United States Patent
Johnson et al.

(10) Patent No.: US 11,306,550 B2
(45) Date of Patent: Apr. 19, 2022

(54) SEAL CONDITION MONITORING

(71) Applicant: AMERIFORGE GROUP INC., Houston, TX (US)

(72) Inventors: Austin Johnson, Houston, TX (US); Justin Fraczek, Spring, TX (US); Waybourn Anderson, Jr., Houston, TX (US); Brian Piccolo, Houston, TX (US); Saravanan Sundaramoorthy, Houston, TX (US); Alexander John MacGregor, Houston, TX (US); Kareem Ahmed Ameen Amer, Houston, TX (US); George James Michaud, Katy, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

(21) Appl. No.: 16/896,612

(22) Filed: Jun. 9, 2020

(65) Prior Publication Data

US 2020/0300051 A1 Sep. 24, 2020

Related U.S. Application Data

(63) Continuation of application No. PCT/US2018/064839, filed on Dec. 11, 2018.
(Continued)

(51) Int. Cl.

| | |
|---|---|
| ***E21B 21/08*** | (2006.01) |
| ***E21B 33/08*** | (2006.01) |
| ***E21B 47/06*** | (2012.01) |

(52) U.S. Cl.
CPC ..... *E21B 21/08* (2013.01); *E21B 33/08* (2013.01); *E21B 47/06* (2013.01); *E21B 33/085* (2013.01)

(58) Field of Classification Search
CPC ..... E21B 33/068; E21B 33/08; E21B 21/08; E21B 47/06; E21B 33/085; E21B 47/117
See application file for complete search history.

(56) References Cited

U.S. PATENT DOCUMENTS

| | | | |
|---|---|---|---|
| 3,561,723 | A | 2/1971 | Cugini |
| 3,955,822 | A | 5/1976 | Irby |

(Continued)

FOREIGN PATENT DOCUMENTS

| | | | |
|---|---|---|---|
| WO | 2019118394 | A1 | 6/2019 |
| WO | 2020081175 | A1 | 4/2020 |

(Continued)

OTHER PUBLICATIONS

Johnson, Austin, Fraczek, Justin, and Anderson, Bo, Enhancing Technology Development Process Through Purpose-Built Testing and Training Facilities, Paper presented at the IADC/SPE Asia Pacific Drilling Technology Conference held in Bangkok, Thailand, Aug. 27-29, 2018, published as IADC/SPE-191038-MS by the Society of Petroleum Engineers.

(Continued)

*Primary Examiner* — Brad Harcourt
(74) *Attorney, Agent, or Firm* — Basil M. Angelo; Angelo IP

(57) ABSTRACT

A method of seal condition monitoring may determine the state of the annular seal, the state of one or more sealing elements, take actions to maintain the annular seal as one or more sealing elements transition from new to worn, and provide advance notice of the impending failure of one or more sealing elements so as to avoid a catastrophic annular seal failure while the marine riser is pressurized. Advantageously, operations may be conducted proactively rather than reactively, and one or more sealing elements may be replaced well in advance of failure, but potentially later than a conventional maintenance schedule would dictate. The one (Continued)

or more failing sealing elements may be proactively replaced without depressurizing the marine riser, prior to seal failure or replacement may be planned well in advance and coordinated with other rig operations to improve efficiency and maintain the safety of the drilling rig and personnel.

22 Claims, 15 Drawing Sheets

Related U.S. Application Data

(60) Provisional application No. 62/597,601, filed on Dec. 12, 2017, provisional application No. 62/747,086, filed on Oct. 17, 2018.

(56) References Cited

U.S. PATENT DOCUMENTS

| | | | | |
|---|---|---|---|---|
| 9,939,097 | B2 | 4/2018 | Pendleton | |
| 10,024,310 | B2 | 7/2018 | Pendleton | |
| 10,577,878 | B2 | 3/2020 | Johnson et al. | |
| 10,590,721 | B2 | 3/2020 | Johnson et al. | |
| 10,655,410 | B2 | 5/2020 | Johnson et al. | |
| 10,995,573 | B2 | 5/2021 | Fraczek et al. | |
| 11,008,825 | B2 | 5/2021 | Fraczek et al. | |
| 2009/0152006 | A1 | 6/2009 | Leduc et al. | |
| 2010/0175882 | A1 | 7/2010 | Bailey et al. | |
| 2011/0024195 | A1 | 2/2011 | Hoyer et al. | |
| 2011/0253445 | A1 | 10/2011 | Hannegan et al. | |
| 2012/0217022 | A1* | 8/2012 | Michaud | E21B 33/08 166/378 |
| 2012/0272764 | A1 | 11/2012 | Pendleton | |
| 2013/0105141 | A1 | 5/2013 | Bernard et al. | |
| 2013/0168578 | A1 | 7/2013 | Leuchtenberg et al. | |
| 2014/0231075 | A1* | 8/2014 | Springett | E21B 33/064 166/250.01 |
| 2014/0238686 | A1 | 8/2014 | Boyd | |
| 2014/0311735 | A1 | 10/2014 | Landrith et al. | |
| 2015/0144400 | A1 | 5/2015 | Leuchtenberg et al. | |
| 2015/0376972 | A1 | 12/2015 | Lock | |
| 2016/0010411 | A1 | 1/2016 | Al-Rabeh | |
| 2016/0186515 | A1 | 6/2016 | Gilmore et al. | |
| 2016/0186908 | A1 | 6/2016 | Pendleton | |
| 2017/0009550 | A1 | 1/2017 | Leuchtenberg et al. | |
| 2017/0044857 | A1* | 2/2017 | Leuchtenberg | E21B 21/10 |
| 2017/0191333 | A1 | 7/2017 | Lewis et al. | |
| 2018/0258730 | A1 | 9/2018 | Grace et al. | |
| 2019/0055791 | A1 | 2/2019 | Barela | |
| 2019/0120000 | A1 | 4/2019 | Santos | |
| 2019/0145203 | A1 | 5/2019 | Johnson et al. | |
| 2019/0145204 | A1 | 5/2019 | Johnson et al. | |
| 2019/0145205 | A1 | 5/2019 | Johnson et al. | |
| 2020/0300051 | A1 | 9/2020 | Johnson et al. | |
| 2020/0300052 | A1 | 9/2020 | Johnson et al. | |
| 2020/0362651 | A1 | 11/2020 | Fraczek et al. | |
| 2020/0362659 | A1 | 11/2020 | Fraczek et al. | |
| 2021/0207447 | A1 | 7/2021 | Fraczek et al. | |
| 2021/0230963 | A1 | 7/2021 | Johnson et al. | |
| 2021/0246754 | A1 | 8/2021 | Fraczek et al. | |
| 2021/0246755 | A1 | 8/2021 | Johnson et al. | |

FOREIGN PATENT DOCUMENTS

| | | | |
|---|---|---|---|
| WO | 2020091900 | A1 | 5/2020 |
| WO | 2021150299 | | 11/2020 |
| WO | PCTUS2020061178 | | 11/2020 |

OTHER PUBLICATIONS

Johnson, Austin, Nichols, Jess, Ameen, Kareem, and Fraczek, Justin, Simulated Drilling Testing of an Active Wellbore Sealing System on a Full-Scale Test Rig, Paper presented at the SPE/IADC Drilling International Conference and Exhibition held in The Hague, The Netherlands, Mar. 5-7, 2019, published as SPE/IADC-194079-MS by the Society of Petroleum Engineers.

Johnson, Austin, Sundaramoorthy, Saravanan, Piccolo, Brian, and Fraczek, Justin, Real Time Condition Monitoring of the Wellbore Seal through Hydraulic Fluid Analysis Using an Active Wellbore Sealing System during Manged Pressure Drilling, Paper presented at Offshore Technology Conference Asia held in Kuala Lumpur, Malaysia, Mar. 20-23, 2018, published as OTC-28436-MS by Offshore Technology Conference.

PCT International Search Report for PCT International Application PCT/US2018/064839, filed Dec. 11, 2018, dated Feb. 27, 2019.

PCT Written Opinion of the International Search Authority for PCT International Application PCT/US2018/064839, filed Dec. 11, 2018, dated Feb. 27, 2019.

U.S. Appl. No. 17/233,082, filed Apr. 16, 2021, Austin Johnson.

European Patent Office Extended European Search Report for EP 18888557.8 filed on May 28, 2020, dated Jun. 29, 2021.

PCT International Search Report of International Search Authority (USPTO) for PCT/US2020/061178, filed on Nov. 19, 2020, dated Feb. 9, 2021.

PCT International Search Report of the International Searching Authority (USPTO) for PCT International Application PCT/US2019/051234 dated Nov. 19, 2019.

PCT International Search Report of the International Searching Authority (USPTO) for PCT International Application PCT/US2019/051245 dated Nov. 19, 2019.

PCT Written Opinion of International Search Authority (USPTO) for PCT/US2020/061178, filed on Nov. 19, 2020, dated Feb. 9, 2021.

PCT Written Opinion of the International Searching Authority (USPTO) for PCT International Application PCT/US2019/051234 dated Nov. 19, 2019.

PCT Written Opinion of the International Searching Authority (USPTO) for PCT International Application PCT/US2019/051245 dated Nov. 19, 2019.

USPTO non-final office action issued in U.S. Appl. No. 16/896,625, filed Jun. 9, 2020, dated Aug. 31, 2021.

USPTO non-final office action issued in U.S. Appl. No. 17/233,082, filed Apr. 16, 2021, dated Sep. 1, 2021.

U.S. Appl. No. 62/597,601, filed Dec. 12, 2017, Justin Fraczek.

Applicant reply to USPTO non-final office action issued in U.S. Appl. No. 16/896,625, filed Jun. 9, 2020, submitted to the USPTO on Nov. 10, 2021.

USPTO non-final office action issued in U.S. Appl. No. 17/244,078, filed Apr. 29, 2021, dated Jan. 13, 2022.

* cited by examiner

SEAL CONDITION MONITORING

CROSS-REFERENCE TO RELATED APPLICATIONS

This application is a continuation of PCT International Application PCT/US2018/064839, filed on Dec. 11, 2018, which claims the benefit of, or priority to, U.S. Provisional Patent Application Ser. No. 62/597,601, filed on Dec. 12, 2017, and U.S. Provisional Patent Application Ser. No. 62/747,086, filed on Oct. 17, 2018, all of which are hereby incorporated by reference in their entirety for all purposes.

BACKGROUND OF THE INVENTION

Efficient drilling techniques typically maintain downhole pressure in a range between the pore pressure and the fracture pressure. This pressure window is sometimes referred to as the drilling margin and represents the gradient within which little or no formation fluids are drawn into the well and little or no drilling fluids are lost to the formation itself. While drilling fluids are typically weighted, other factors including fluid friction, pipe rotation, and applied surface back pressure ("ASBP") contribute to the downhole pressure acting on the exposed downhole formation. Failure to precisely control these variables can result in a well control event including the unintentional influx of formation fluids into the wellbore or the loss of expensive drilling fluids to the formation. Consequently, deviation from the drilling margin substantially increases drilling costs and exposes the drilling rig and personnel to dangerous conditions including, potentially, a blowout.

Managed pressure drilling ("MPD") systems seal the annulus surrounding the drill pipe for all operations, including rotating and stripping, and improve the ability of the drilling rig to manage downhole pressure. With the wellbore sealed, MPD systems allow for the application of surface back pressure to the well. The drilling rig may apply additional surface back pressure to increase the pressure overbalance acting on the formation or may drill ahead with back pressure to allow for rapid downward bottom hole pressure adjustment to mitigate fluid losses. During connections, surface back pressure may be increased to offset the loss of circulating friction that occurs as the mud pumps are stopped. Typically, pressure is increased during connections by an amount proportional to the difference between the equivalent circulating density ("ECD") and the equivalent static density ("ESD").

Advantageously, MPD systems allow the drilling rig to more quickly detect warning signs of a potentially hazardous situation. With the annulus closed, all returning fluids may be measured with greater accuracy, enabling faster kick and loss detection than is available using conventional drilling techniques. Faster detection and response time results in a smaller influx because the duration of the underbalanced condition is reduced. Smaller influxes are typically easier to circulate out of the well because there is typically less gas or light annular fluids that place less stress on weaker formations. In the event an unintentional influx is taken into the wellbore, MPD systems may be used to apply surface back pressure to the well to stop the influx before shutting the blowout preventer ("BOP"), which eliminates drawdown pressure acting on the formation following mud pump shutdown and closure of the BOP and further reduces the influx volume.

Conventional MPD systems typically include an annular sealing system, a drill string isolation tool, and a flow spool, or equivalents thereof, that actively manage wellbore pressure during drilling and other operations. The annular sealing system typically includes a rotating control device ("RCD"), an active control device ("ACD"), or other type of annular sealing system that is configured to seal the annulus surrounding the drill pipe while it rotates. The annulus is encapsulated such that it is not exposed to the atmosphere. The drill string isolation tool is disposed directly below the annular sealing system and includes an annular packer that encapsulates the well and maintains annular pressure when rotation has stopped and the annular sealing system, or components thereof, are being installed, serviced, removed, or otherwise disengaged. The flow spool is disposed directly below the drill string isolation tool and, as part of the pressurized fluid return system, diverts fluids from below the annular seal to the surface. The flow spool is in fluid communication with the choke manifold, typically disposed on a platform of the drilling rig, that is in fluid communication with a mud-gas separator, shakers, or other fluids processing system. The pressure tight seal on the annulus allows for the precise control of wellbore pressure by manipulation of the choke settings of the choke manifold and the corresponding application of surface back pressure. MPD systems are increasingly being used in deepwater and ultra-deepwater applications where the precise management of wellbore pressure is required for technical, environmental, and safety reasons.

BRIEF SUMMARY OF THE INVENTION

According to one aspect of one or more embodiments of the present invention, a method of seal condition monitoring for an annular sealing system may include engaging an upper annular packer system to engage an upper sealing element to form an upper interference fit that seals an annulus surrounding a drill pipe, determining an upper closing pressure required for an upper annular packer of the upper annular packer system to sufficiently close on the upper sealing element to form the upper interference fit, during drilling operations, actively adjusting the upper closing pressure to maintain the upper interference fit, and if a change in the upper closing pressure required to maintain the upper interference fit exceeds a predetermined amount over a predetermined period of time, providing an operator an alert indicating that the upper sealing element is worn.

According to one aspect of one or more embodiments of the present invention, a method of seal condition monitoring for an annular sealing system may include taring an upper flow meter of a hydraulic power unit configured to provide hydraulic power to one or more upper actuating pistons of an upper annular packer system, engaging the upper annular packer system to engage an upper sealing element to close on a drill pipe up to a predetermined upper calibration pressure, monitoring the upper flow meter to determine an upper closing chamber volume for a predetermined period of time, determining a condition of the upper sealing element based on a predetermined relationship between the upper closing chamber volume and an extent to which the upper sealing element is worn, and providing an operator with an indication of the extent to which the upper sealing element is worn based on the determined condition.

According to one aspect of one or more embodiments of the present invention, a method of seal condition monitoring for an annular sealing system may include generating modeled data including one or more of a modeled upper closing pressure of an upper annular packer of an upper annular packer system, a modeled wellbore pressure, and a modeled lubrication chamber pressure of the annular sealing system for anticipated drilling operations and conditions, inputting measured data including one or more of a measured upper closing pressure of the upper annular packer of the upper annular packer system, a measured wellbore pressure, and a measured lubrication chamber pressure of the annular sealing system for drilling operations and conditions, comparing measured data with modeled data to determine a condition of the upper sealing element, and providing an operator with the condition of the upper sealing element.

According to one aspect of one or more embodiments of the present invention, a system for seal condition monitoring may include an active control device annular sealing system having an upper annular packer system comprising a piston-actuated upper annular packer configured to engage an upper sealing element to close on a drill pipe to form an upper interference fit that seals the annulus surrounding the drill pipe, a lower annular packer system comprising a piston-actuated lower annular packer configured to engage a lower sealing element to close on the drill pipe to form a lower interference fit that seals the annulus surrounding the drill pipe, a lubrication chamber disposed in between the upper annular packer system and the lower annular packer system comprising a lubrication injection port and a pressure relief valve, and an active control system configured to measure one or more of an upper closing pressure of the upper annular packer system, an upper closing chamber volume of the upper annular packer system, a lubrication chamber pressure, a wellbore pressure, a lower closing pressure of the lower annular packer system, and a lower closing chamber volume of the lower annular packer system. The active control system provides an operator with one or more of a condition of the upper sealing element and the lower sealing element or an indication of the extent to which the upper sealing element and the lower sealing element are worn.

Other aspects of the present invention will be apparent from the following description and claims.

DETAILED DESCRIPTION OF THE INVENTION

Figure 1A:
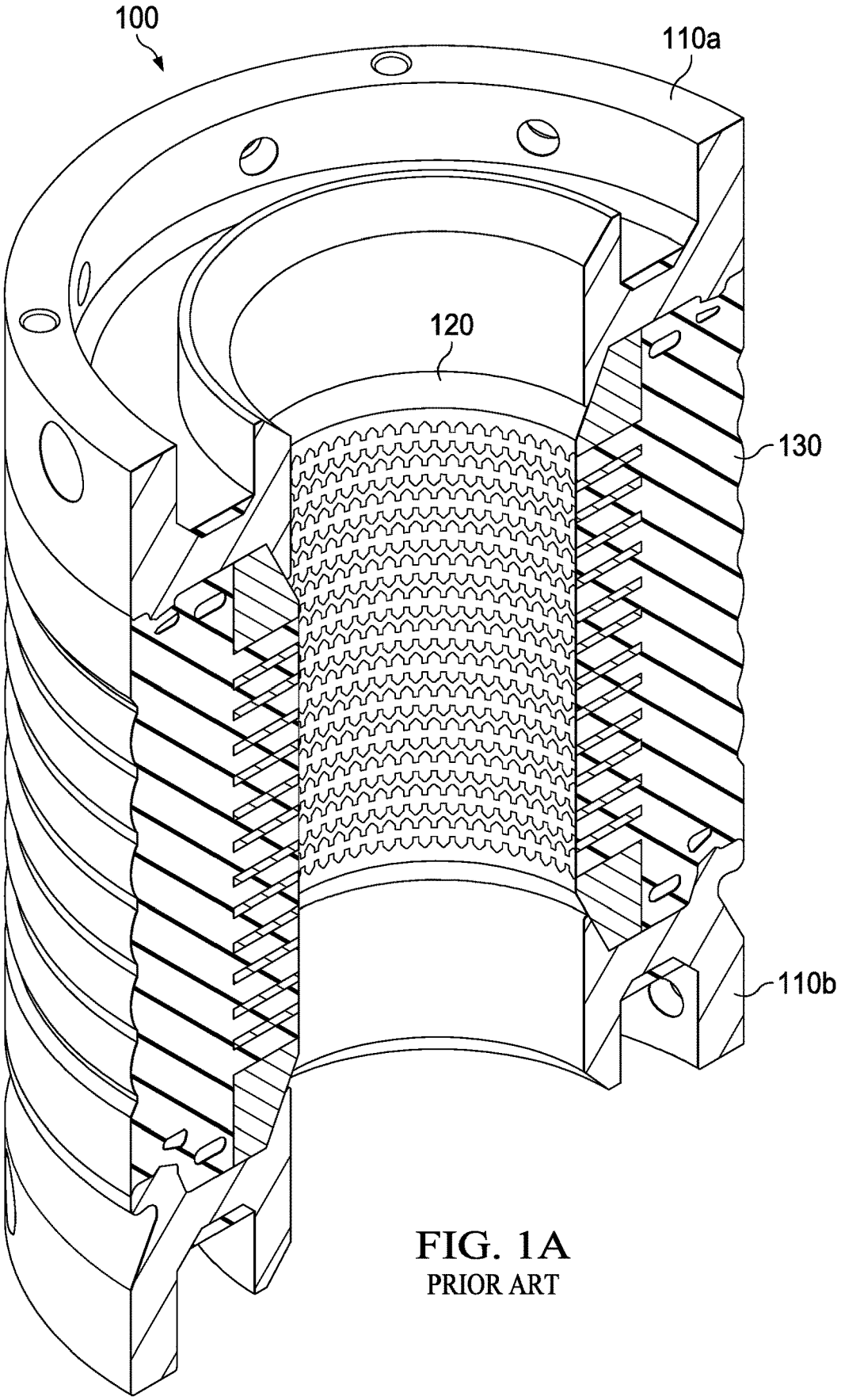
FIG. 1A PRIOR ART
FIG. 1A shows a cross-sectional perspective view of a sealing element of an ACD-type annular sealing system.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are purposefully not described to avoid obscuring the description of the present invention.

In deepwater and ultra-deepwater applications of below-tension-ring MPD systems, an integrated MPD riser joint is typically disposed below the waterline as part of the upper marine riser system. The integrated MPD riser joint typically includes an annular sealing system disposed below a bottom distal end of the outer barrel of the telescopic joint, a drill string isolation tool, or equivalent thereof, disposed below the annular sealing system, and a flow spool, or equivalent thereof, disposed below the drill string isolation tool. The annular sealing system may be an RCD-type, ACD-type, or other type or kind of annular sealing system that is configured to seal the annulus surrounding drill pipe such that the annulus is encapsulated and is not exposed to the atmosphere.

In a conventional RCD-type annular sealing system, one or more passive sealing elements, disposed within one or more seal and bearing assemblies, form an interference fit with the drill pipe and are configured to rotate with the drill pipe. The interference between the bearing assembly and the RCD housing typically includes complimentary sealing surfaces and a passive seal pack such as an O-ring. Relying primarily on the interference fit, a passive sealing element is energized from the moment the drill pipe is concentrically inserted to the moment it either fails or the drill pipe is removed. High maintenance costs are incurred when the bearing mechanism is serviced between runs to reduce the chance of a sudden failure. Some methods exist to monitor the condition of the bearing mechanism such as monitoring the temperature or speed of rotation, but the relatively simple design of a passive element is difficult to effectively monitor in practice. In addition to high maintenance costs, and the uncertain status and life of the one or more sealing elements, special preparations must be made for non-MPD hole sections in order to protect the sealing surfaces on the passive RCD housing, resulting in an additional restriction of the drill through the inner diameter of the device. Because there is no method to effectively monitor the condition of the one or more sealing elements within their respective housings, high maintenance costs are incurred when the one or more sealing elements are inspected, bearing assemblies are repaired, or seal and bearing assemblies are replaced, regardless of their condition, on predetermined and conservative maintenance schedules.

In a state-of-the-art ACD-type annular sealing system, a removable dual seal sleeve may be used that includes an upper sealing element and a lower sealing element that are disposed on opposing ends of a mandrel. The upper and lower sealing elements of the dual seal sleeve are disposed within upper and lower annular packer systems respectively of the ACD-type annular sealing system. When engaged, the upper and lower annular packer systems engage the upper and lower sealing elements respectively and cause the sealing elements to controllably close radially inward and form an interference fit with the drill pipe, thereby sealing the annulus surrounding the drill pipe while the drill pipe rotates. While dual seal sleeves are conventionally used, other configurations of sealing elements, including independent sealing elements disposed on separate mandrels, may be used in accordance with one or more embodiments of the present invention. Advantageously, ACD-type annular sealing systems address the disadvantages of RCD-type annular sealing systems and present an opportunity for further improvement to MPD systems that enhance the operation of drilling rigs and the safety of personnel.

The drill string isolation tool, or equivalent thereof, provides an additional sealing element that encapsulates the well and seals the annulus surrounding the drill pipe when the annular sealing system is disengaged or components thereof are being installed, serviced, maintained, removed, or are otherwise disengaged. The flow spool, or equivalent thereof, is in fluid communication with a choke manifold, typically disposed on a platform of the floating rig, that is in fluid communication with a mud-gas separator, shakers, or other fluids processing system disposed on the surface.

The pressure tight seal on the annulus provided by the annular sealing system allows for the precise control of wellbore pressure by manipulation of the choke settings of the choke manifold and the corresponding application of surface back pressure. If the driller wishes to increase wellbore pressure, one or more chokes of the choke manifold may be closed somewhat more than their last setting to further restrict fluid flow and apply additional surface back pressure. Similarly, if the driller wishes to decrease wellbore pressure, one or more chokes of the choke manifold may be opened somewhat more than their last setting to increase fluid flow and reduce the amount of surface back pressure applied. Such MPD systems allow for the selective application of surface back pressure as part of adaptive drilling techniques. As such, the wellbore and marine riser system may be isolated and pressurized and wellbore pressure may be precisely controlled by application of surface back pressure. MPD systems are used in various types of drilling operations including underbalanced drilling ("UBD"), pressurized mud cap drilling ("PMCD"), floating mud cap drilling ("FMCD"), and ASBP-MPD applications.

In some subsea drilling applications, the wellbore pressure may be managed within a pressure window bounded by the pore pressure and the fracture pressure of the section. Maintaining downhole pressure higher than the pore pressure prevents the unintentional influx of formation fluids, sometimes referred to as a kick, into the wellbore. However, if during drilling operations, a zone is encountered where the pore pressure is higher than the wellbore pressure, an unintentional influx of formation fluids may be introduced into the wellbore that may include unknown gases, liquids, or combinations thereof. The influx of formation fluids may reduce the net density of fluids that further exacerbates the problem by drawing even more formation fluids into the wellbore. Explosive gases may enter the marine riser system posing a significant risk of a dangerous blowout endangering the safety of personnel and potentially fouling the environment. Many wells are drilled with a slightly overbalanced condition where the loss of filtrate is accepted in order to develop a low permeability filter cake on the wellbore. Wellbore pressure below the pore pressure, an underbalanced condition, is also likely to result in an influx of formation fluids into the well, which if not controlled, can lead to the loss of the well section or a dangerous blowout. Exceeding the fracture pressure is also hazardous as the loss of drilling fluids into the formation can lower the fluid level in the annulus, thereby lowering downhole pressure, potentially inviting an influx into the well from another exposed formation. In either case, the deviation from the drilling margin may endanger the safety of personnel, potentially foul the environment, and dramatically increase the cost of drilling operations. Consequently, the annular seal is critical to the prevention of kicks or losses, the detection of kicks or losses when they cannot be avoided, and the mitigation of well control events to prevent dangerous blowouts. Thus, the effectiveness of the annular seal is key to the safety of operations.

Rig personnel regularly perform maintenance on various equipment, devices, and systems of the drilling rig to ensure that the rig is operable and ready for service. Conventionally, a preventive maintenance strategy has been used where maintenance is performed at predetermined time intervals or after the accumulation of service hours. While this simple approach to preventative maintenance is effective at keeping equipment fit for service, there is no consideration given as to whether certain equipment, a device, or a system could have been operated for a longer period of time before being taken offline for maintenance, leading to waste. Recently, data acquisition and processing systems have be used to develop condition monitoring ("CM") systems that detect and identify developing faults in a system or subsystem. Such information may be used to slow the propagation of system faults. Condition-based maintenance ("CBM") techniques have been adopted to perform maintenance based on the condition as indicated by the CM systems. For example, a CBM program may perform maintenance based on the measured condition of equipment, devices, or systems to increase productive availability while reducing maintenance expenses and operating costs.

While the transition to ACD-type annular sealing systems has provided a significant number of technical advantages to MPD operations, no CM systems or CBM techniques presently exist to monitor the condition of the sealing elements of the ACD-type annular sealing system. Given the critical importance of maintaining the annular seal to the safety of operations, ACD-type annular sealing systems use redundant sealing elements, such as, for example, the upper sealing element and the lower sealing element, discussed above, that are typically disposed on opposing ends of an intermediate spacer mandrel. The upper sealing element and the lower sealing element are typically engaged at the same time, thereby providing a redundant annular seal during drilling operations. However, one or more sealing elements of the dual seal sleeve may fail, independent of one another, from regular use or due to an unexpected mechanical or material failure. When such a failure occurs, drilling operations must be stopped, the drill string isolation tool must be engaged to maintain the annular seal, if possible, and the sealing elements must be pulled, inspected, and replaced. Worse yet, when the failure of one or more sealing elements occurs unexpectedly, without notice, well control may be lost, and the marine riser may depressurize giving rise to an incredibly dangerous situation and potentially a blowout. To date, ACD-type annular sealing systems replace sealing elements on a predetermined schedule or merely react to critical failures of sealing elements after the fact, putting the rig, the environment, and rig personnel at grave risk.

Accordingly, in one or more embodiments of the present invention, a method of seal condition monitoring may determine the state of the annular seal, the condition of one or more sealing elements, take actions to maintain the annular seal as one or more sealing elements transition from a new condition to a worn condition, and provide advance notice of the impending failure of one or more sealing elements so as to avoid a catastrophic annular seal failure while the marine riser is pressurized. Advantageously, operations may be conducted proactively rather than reactively, and one or more sealing elements may be replaced well in advance of failure, but potentially later than a conventional maintenance schedule would dictate. In certain embodiments, the one or more worn sealing elements may be proactively replaced without depressurizing the marine riser and prior to seal failure. In other embodiments, the replacement of one or more worn sealing elements may be planned in advance, and coordinated with other rig operations, to improve efficiency and maintain the safety of the rig and personnel.

Figure 1B:
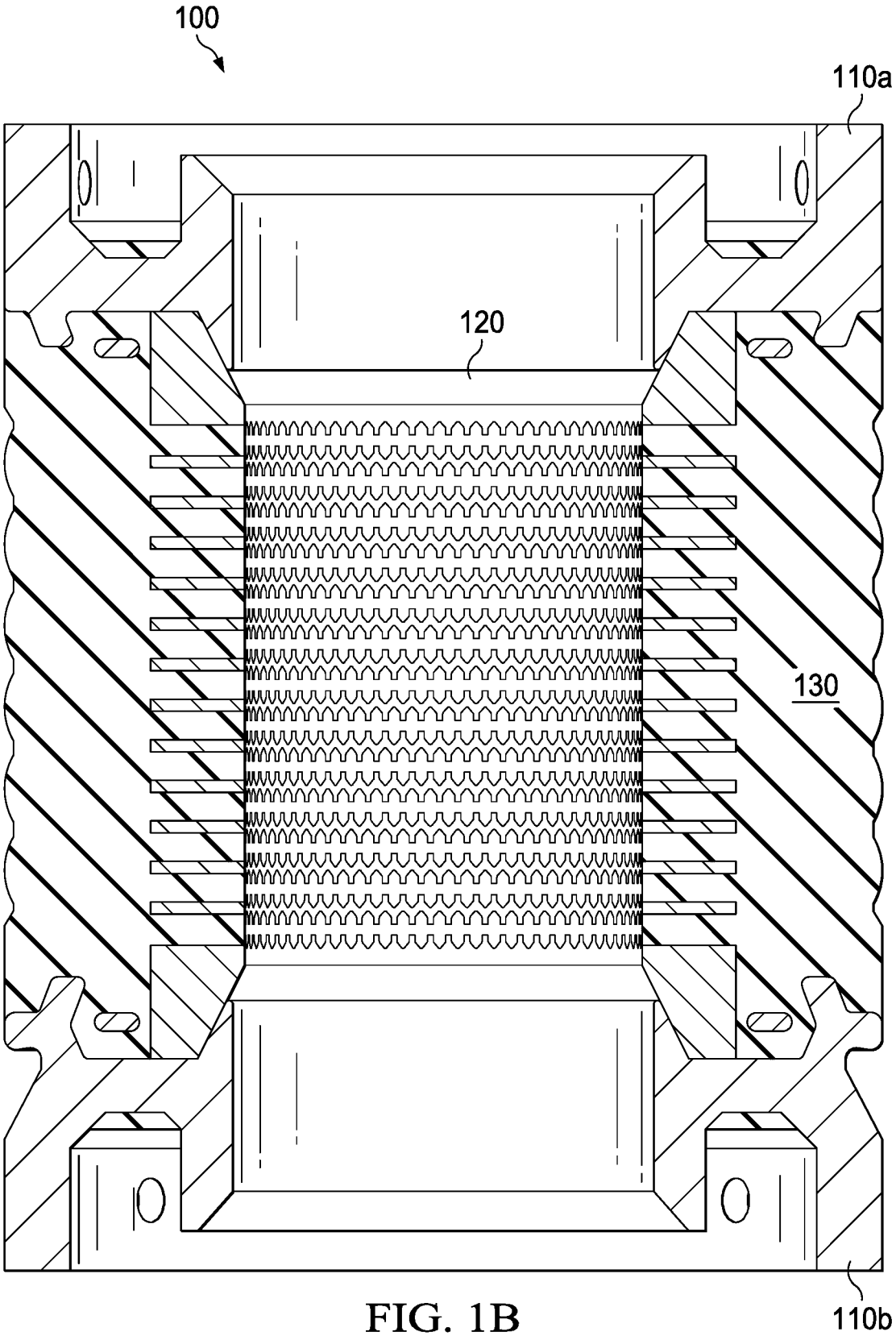
FIG. 1B PRIOR ART
FIG. 1B shows a cross-sectional elevation view of the sealing element of the ACD-type annular sealing system.

FIG. 1A shows a cross-sectional perspective view of a sealing element 100 of an ACD-type annular sealing system (not shown). Sealing element 100 may include an upper-end interface 110*a,* a wear-resistant seal insert 120 co-molded with a buffer material 130 that serves as a secondary seal to seal insert 120, and a lower-end interface 110*b.* Sealing element 100 may include an inner diameter configured to receive drill pipe (not shown) therethrough and, when engaged, is configured to squeeze and seal the annulus surrounding the drill pipe (not shown) with an interference fit. However, in contrast to the sealing element of an RCD-type annular sealing system, sealing element 100 of an ACD-type annular sealing system (not shown) does not rotate with the drill pipe (not shown). When sealing element 100 is engaged, seal insert 120 makes contact with the drill pipe (not shown) and provides critical wear resistance as the drill pipe (not shown) rotates. Buffer material 130 supports seal insert 120 and provides a secondary seal in the event seal insert 120 is worn. However, when seal insert 120 is worn, as discussed in more detail herein, buffer material 130 tends to wear very quickly with rotation of the drill pipe (not shown). Seal insert 120 may include a honeycomb, or other matrix pattern that effectively reduces the stiffness of the matrix and increases the surface area of the matrix for bonding with buffer material 130. Continuing, FIG. 1B shows a cross-sectional elevation view of sealing element 100 of the ACD-type annular sealing system (not shown). In certain embodiments, wear-resistant seal insert 120 may be comprised of polytetrafluoroethylene ("PTFE"), ultra-high molecular weight polyethylene, or other polymer-based material that resists wear and buffer material 130 may be comprised of polyurethane, nitrile, acrylonitrile butadiene rubber ("NBR"), hydrogenated acrylonitrile butadiene rubber ("HNBR"), or other elastomer material. One of ordinary skill in the art, having the benefit of this disclosure, will recognize that the material composition of seal insert 120 and buffer material 130 may vary based on an application or design in accordance with one or more embodiments of the present invention.

Figure 2A:
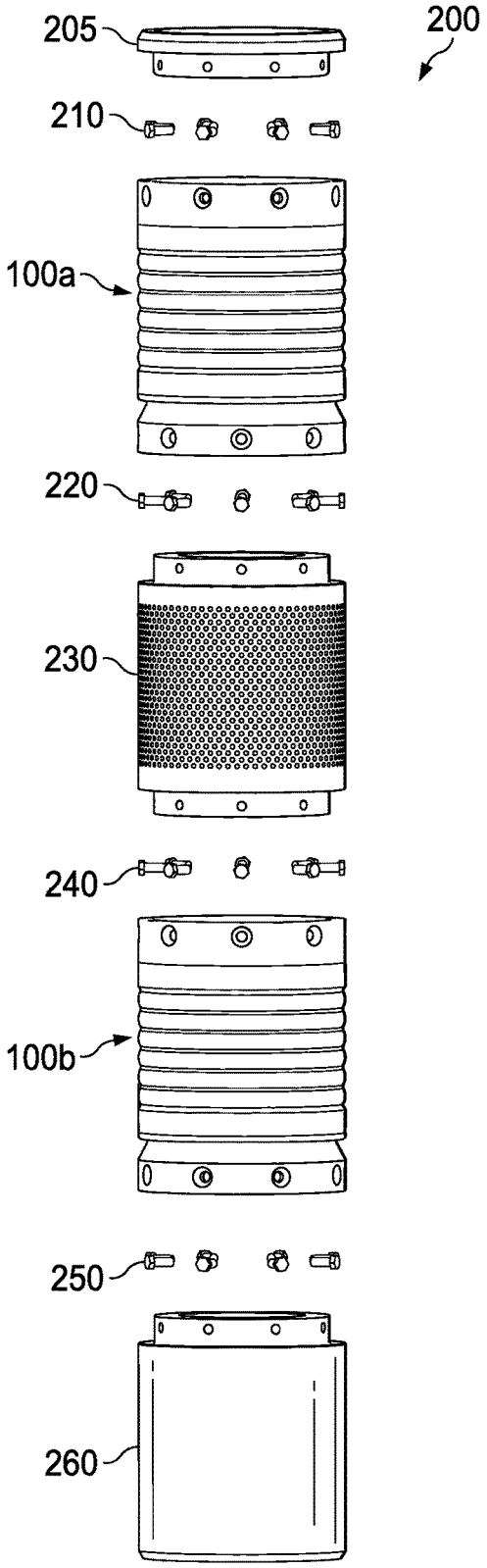
FIG. 2A PRIOR ART
FIG. 2A shows an exploded view of a dual seal sleeve of an ACD-type annular sealing system.
Figure 2B:
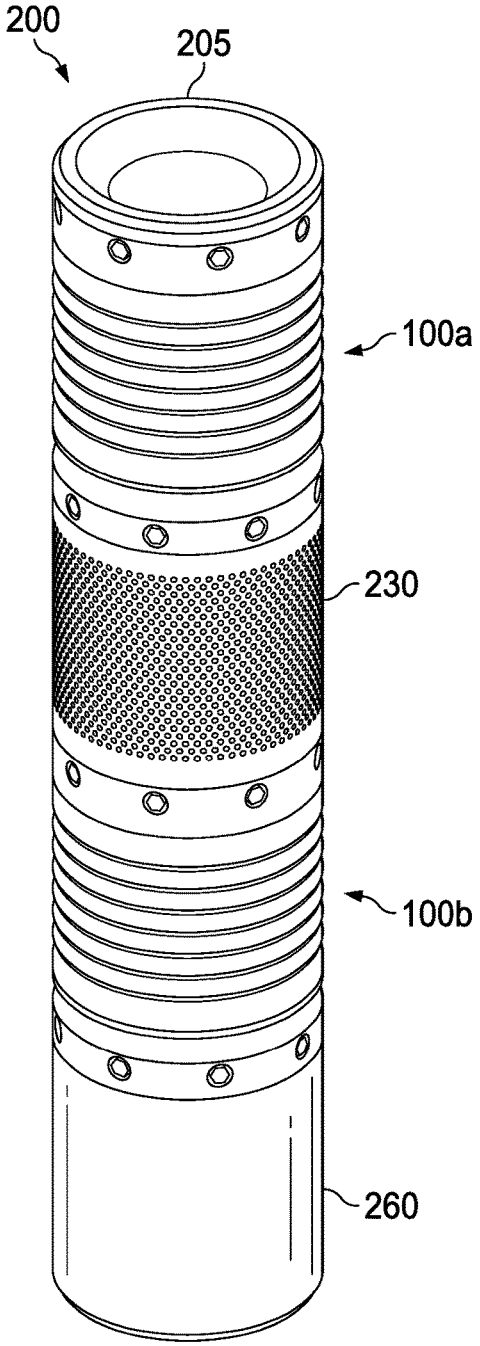
FIG. 2B PRIOR ART
FIG. 2B shows a top-facing perspective view of the dual seal sleeve of the ACD-type annular sealing system.
Figure 2C:
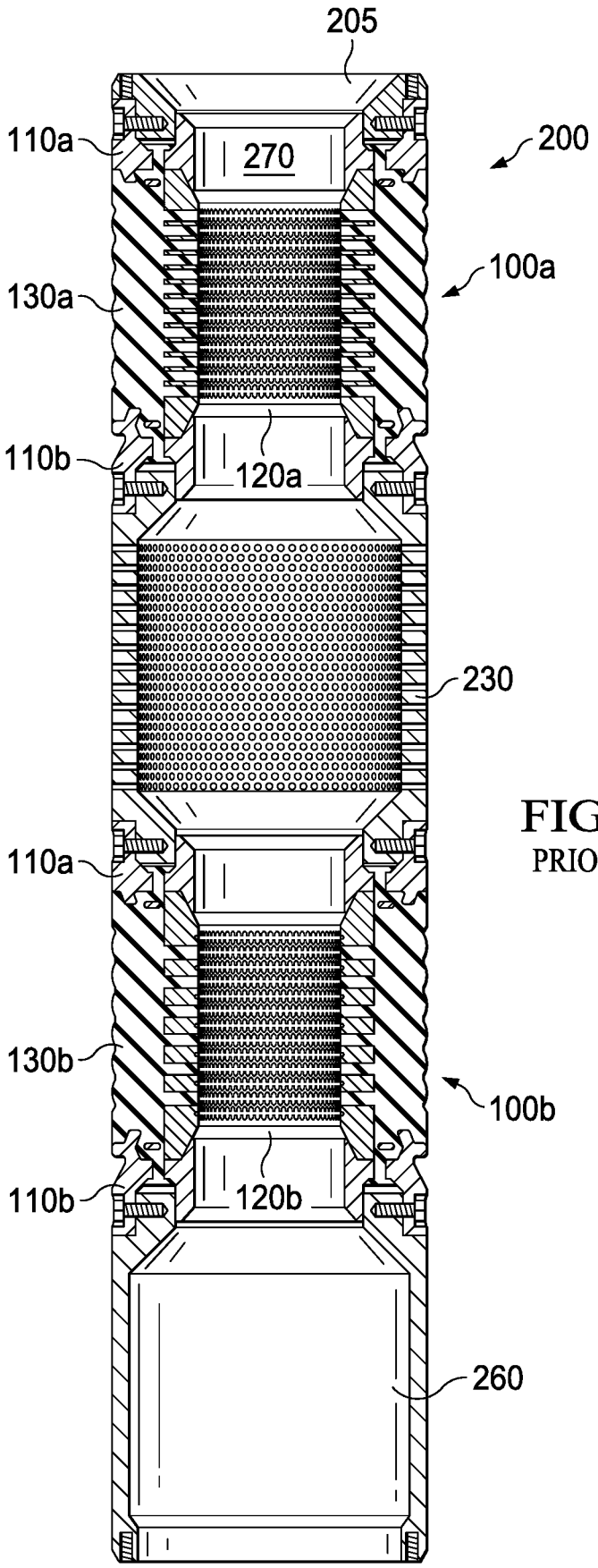
FIG. 2C PRIOR ART
FIG. 2C shows a cross-sectional view of the dual seal sleeve of the ACD-type annular sealing system.

FIG. 2A shows an exploded view of a dual seal sleeve 200 of an ACD-type annular sealing system (not shown). In certain embodiments, the ACD-type annular sealing system (not shown) may use an upper sealing element 100*a* and a lower sealing element 100*b* configured as part of a dual seal sleeve 200. Dual seal sleeve 200 may include an upper end piece 205, a plurality of topside upper sealing element attachment bolts 210, an upper sealing element 100*a,* a plurality of bottomside upper sealing element attachment bolts 220, a vented intermediate spacer 230, a plurality of topside lower sealing element attachment bolts 240, a lower sealing element 100*b,* a plurality of bottomside lower sealing element attachment bolts 250, and a lower end piece 260. In other embodiments, the ACD-type annular sealing system (not shown) may use an upper sealing element 100*a* and a lower sealing element 100*b* that are disposed on separate mandrels or otherwise configured for mutual or independent deployment within the ACD-type annular sealing system (not shown). One of ordinary skill in the art will recognize that the configuration and disposition of the upper sealing element 100*a* and lower sealing element 100*b* may vary based on an application or design in accordance with one or more embodiments of the present invention. Continuing, FIG. 2B shows a top-facing perspective view of the dual seal sleeve 200 of the ACD-type annular sealing system (not shown). Dual seal sleeve 200 may have a central lumen 270 that extends from top to bottom through the length of dual seal sleeve 200 through which drill pipe (not shown) may operatively be disposed. Continuing, FIG. 2C shows a hybrid cross-sectional view of the dual seal sleeve 200 of the ACD-type annular sealing system (not shown) to clarify the arrangement of components.

When upper sealing element 100*a* and lower sealing element 100*b* are engaged (not shown), a cavity (not independently illustrated) may be formed between upper sealing element 100*a* and lower sealing element 100*b* encompassing the inner area of vented intermediate chamber 230. When drilling ahead, the pressure of the cavity (not independently illustrated) may be maintained just above wellbore pressure by injecting a lubrication fluid (not shown) that may be comprised of, for example, active drilling mud, into the cavity (not independently illustrated) to ensure that wellbore fluids do not leak through. The hydraulic-piston actuated closing pressures (not shown) of the upper annular packer (not shown) and the lower annular packer (not shown) of the ACD-type annular sealing system (not shown), that are configured to engage upper sealing element 100*a* and lower sealing element 100*b* respectively, may be adjusted independently to maintain the annular seal (not shown). Lubrication fluid (not shown) may be injected into the lubrication chamber (not independently illustrated) to a desired pressure, typically somewhat higher than the wellbore pressure. The lubrication fluid (not shown) cools and lubricates upper sealing element 100*a* and lower sealing element 100*b*. Because of the rotation of the drill pipe (not shown) and the imperfect seal formed by the sealing elements 100*a* and 100*b*, the injected lubrication fluid (not shown) that lubricates the lower sealing element 100*b* may eventually work its way below lower sealing element 100*b* and join the return flow of fluids (not shown) to the choke manifold (not shown) disposed on the surface (not shown). The lubrication fluid (not shown) that lubricates upper sealing element 100*a* may be collected in the trip tank (not shown). In one or more embodiments of the present invention, the hydraulic closing pressures (not shown) may be actively adjusted to maintain the annular seal (not independently illustrated) as discussed in more detail herein.

Figure 3A:
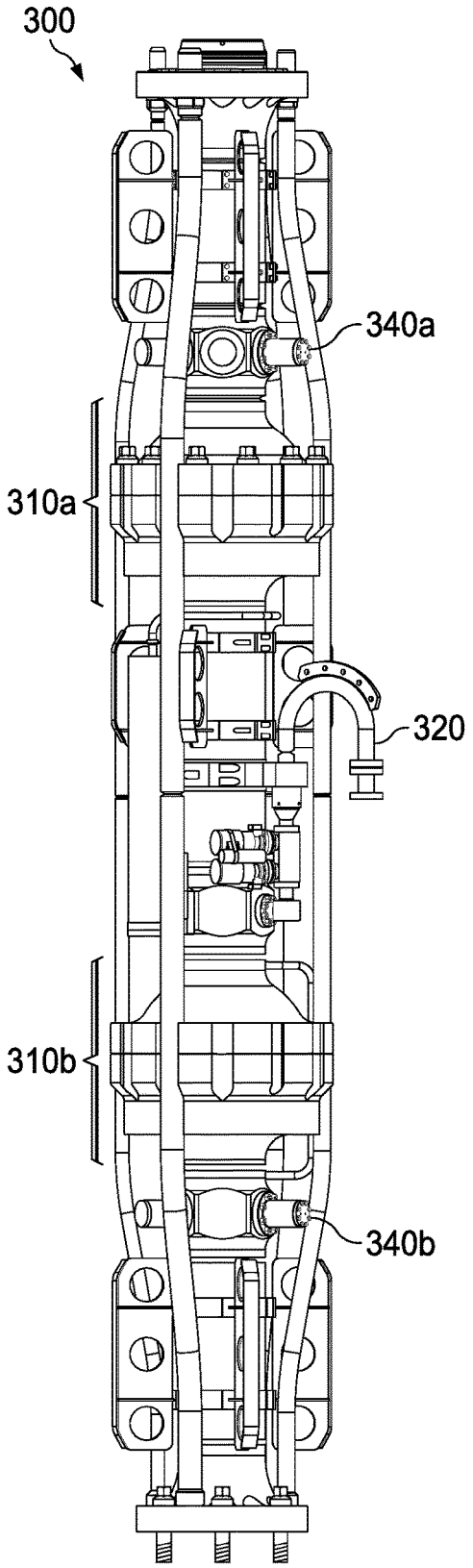
FIG. 3A PRIOR ART
FIG. 3A shows an elevation view of an ACD-type annular sealing system.
Figure 3B:
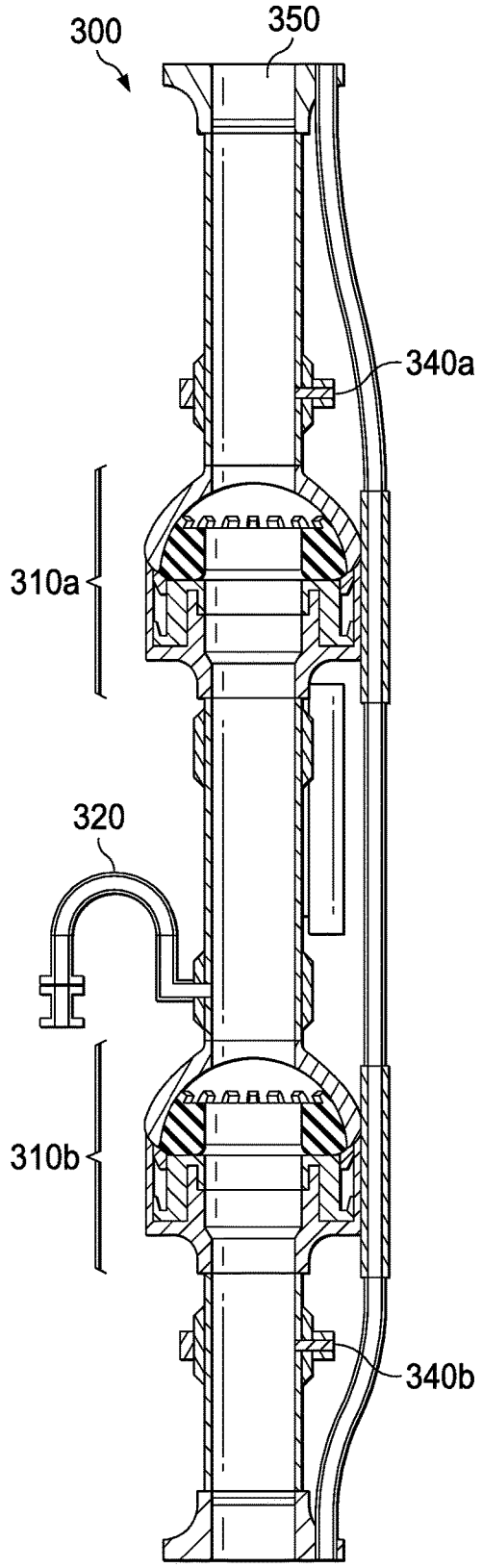
FIG. 3B PRIOR ART
FIG. 3B shows a cross-sectional view of the ACD-type annular sealing system.
Figure 3C:
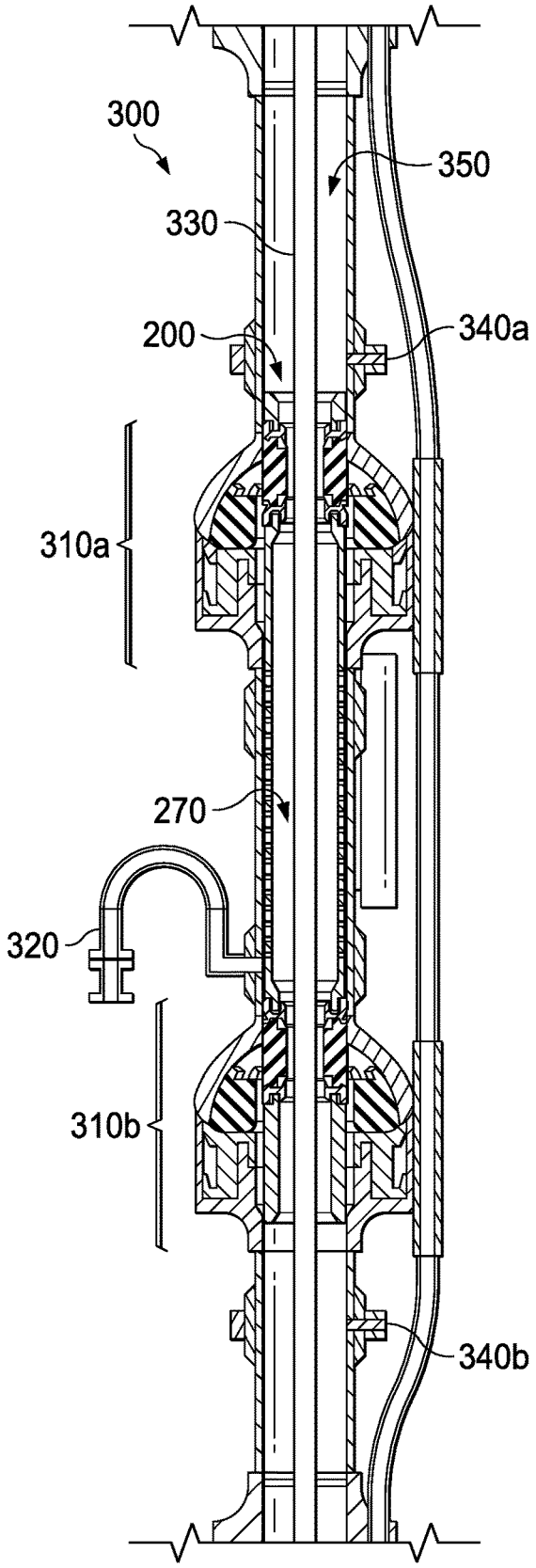
FIG. 3C PRIOR ART
FIG. 3C shows a cross-sectional view of the ACD-type annular sealing system with a dual seal sleeve and drill pipe disposed therein.

FIG. 3A shows an elevation view of an ACD-type annular sealing system 300 for purposes of illustration only. ACD-type annular sealing system 300 may include an upper annular packer system 310*a* and a lower annular packer system 310*b* as discussed in more detail herein. A lubrication injection port 320 may be disposed between upper annular packer system 310*a* and lower annular packer system 310*b*, configured to inject lubrication fluid (not shown) into the lubrication chamber (not independently illustrated) formed there between. Continuing, FIG. 3B shows a cross-sectional view of the ACD-type annular sealing system 300. ACD-type annular sealing system 300 may include a central lumen 350 that extends through the longitudinal length of annular sealing system 300 having an inner diameter suitable to receive the dual seal sleeve (e.g., 200 of FIG. 2) or other configuration of the upper sealing element 100*a* and the lower sealing element 100*b*. The dual seal sleeve (e.g., 200 of FIG. 2) may be disposed within annular sealing system 300 and secured in place with a plurality of upper locking dogs 340*a* and a plurality of lower locking dogs 340*b* that extend radially inward. Continuing, FIG. 3C shows a cross-sectional view of the ACD-type annular sealing system 300 with dual seal sleeve 200 disposed within the central lumen 350 of annular sealing system 300 and operatively positioned within upper annular packer system 310*a* and lower annular packer system 310*b*, with drill pipe 330 disposed through central lumen 270 that extends through an inner diameter of dual seal sleeve 200. In the figure, sealing elements 100*a* and 100*b* of dual seal sleeve 200 are shown disengaged and do not make contact with drill pipe 330 or seal the annulus surrounding drill pipe 330.

Figure 4A:
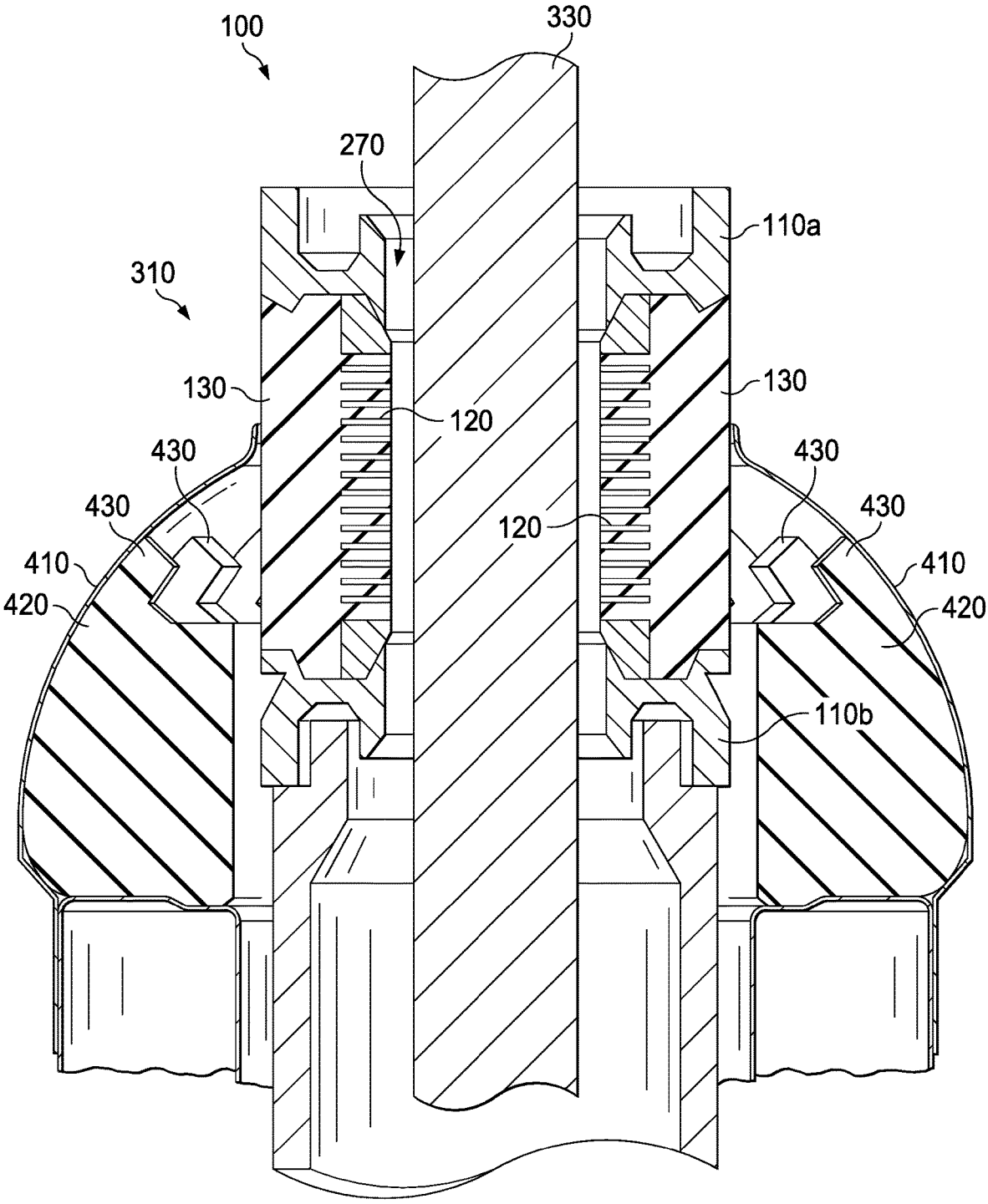
FIG. 4A PRIOR ART
FIG. 4A shows a cross-sectional view of an annular packer system of an ACD-type annular sealing system in a disengaged state.
Figure 4B:
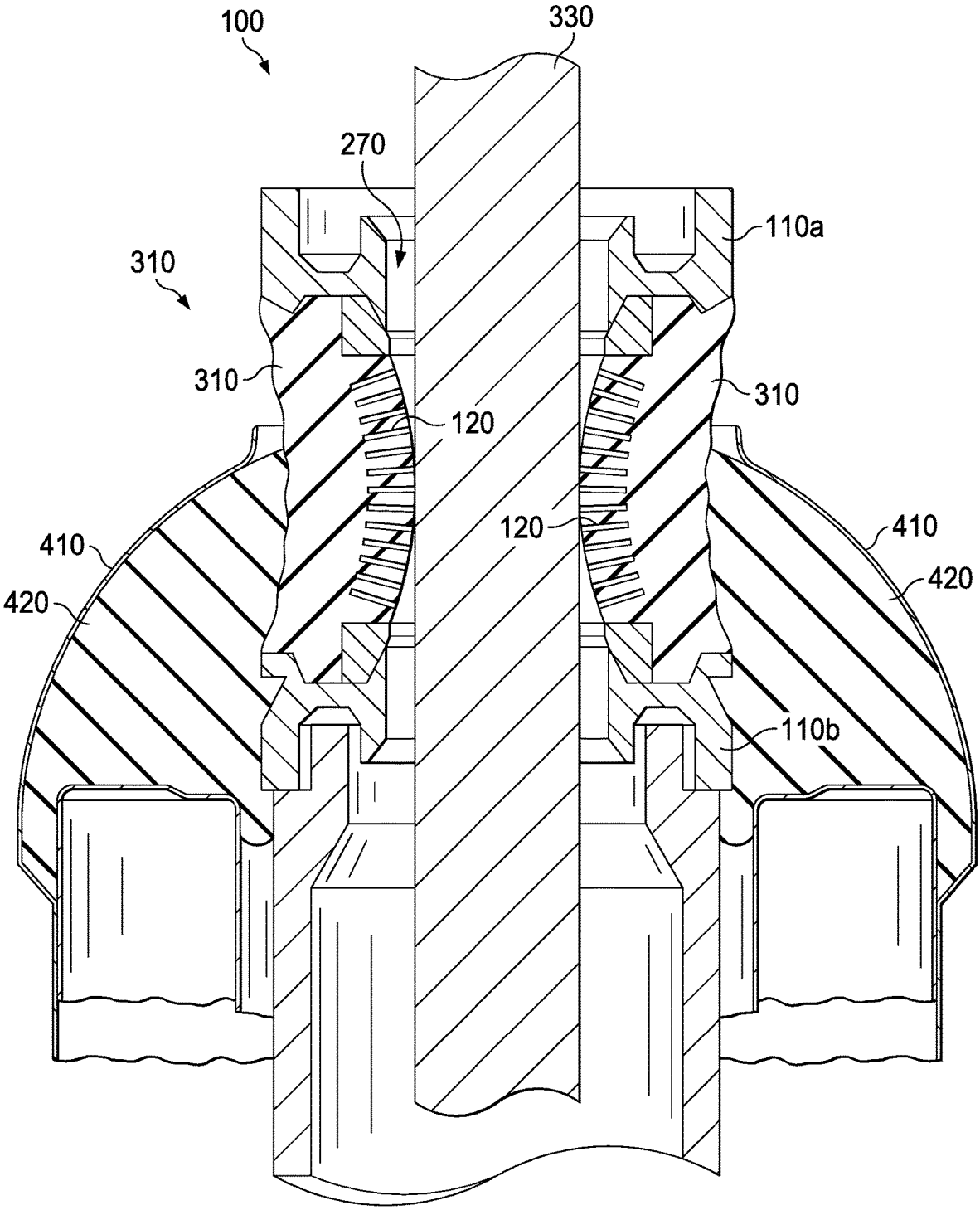
FIG. 4B PRIOR ART
FIG. 4B shows a cross-sectional view of the annular packer system of the ACD-type annular sealing system in an engaged state.

FIG. 4A shows a partial cross-sectional view of an annular packer system 310 of an ACD-type annular sealing system (e.g., 300 of FIG. 3) in a disengaged state. Annular packer system 310 may include a piston-actuated (not shown) annular packer 420 disposed within a radiused housing 410. Annular packer 420 may comprise an elastomer or rubber body with a plurality of fingers or protrusions 430 that are configured to travel within housing 410 when actuated. Sealing element 100 includes a central lumen 270 through which drill pipe 330 may pass therethrough. Continuing, FIG. 4B shows a partial cross-sectional view of the annular packer system 310 of the ACD-type annular sealing system (e.g., 300 of FIG. 3) in an engaged state. When hydraulically actuated, a piston (not shown) causes the elastomer or rubber portion of packer 420 to travel within housing 410 such that packer 420 and fingers 430 come into contact with sealing element 100. When packer 420 is sufficiently actuated, sealing element 100 squeezes drill pipe 330, such that seal insert 120 and buffer material 130 come into contact with a circumference of drill pipe 330 resulting in a pressure tight interference fit surrounding drill pipe 330. Whether engaged or not, sealing element 100 remains stationary while drill pipe 330 rotates.

Figure 5A:
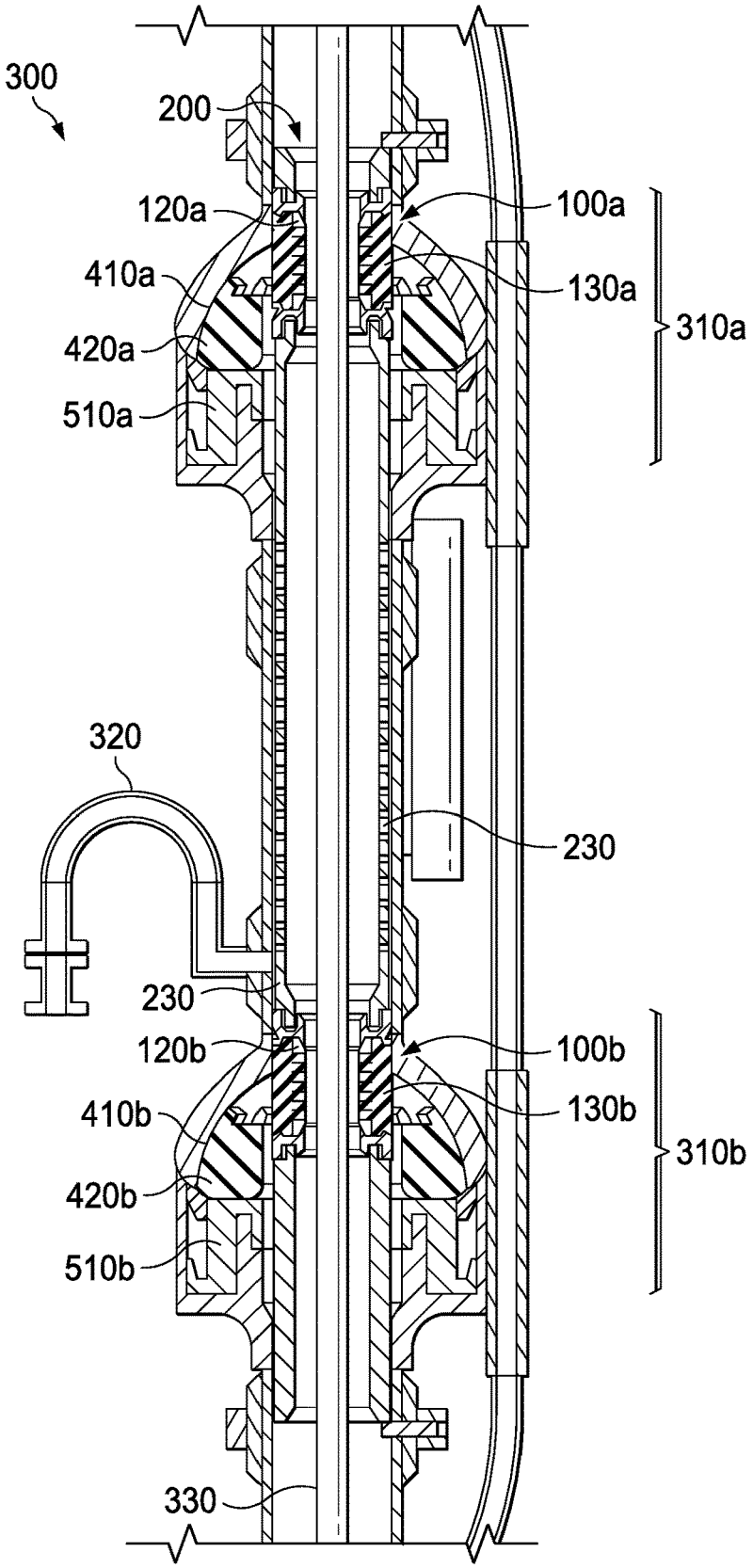
FIG. 5A PRIOR ART
FIG. 5A shows a cross-sectional view of an ACD-type annular sealing system with drill pipe disposed therein with annular packer systems in a disengaged state.

FIG. 5A shows a partial cross-sectional view of an ACD-type annular sealing system (e.g., 300 of FIG. 3) with dual seal sleeve 200 and drill pipe 330 disposed therein, where upper annular packer system 310*a* and lower annular packer system 310*b* are in a disengaged state. As noted above, the ACD-type annular sealing system (e.g., 300 of FIG. 3) typically includes redundant sealing elements 100*a* and 100*b* that are engaged or disengaged at the same time. When upper annular packer system 310*a* and lower annular packer system 310*b* are disengaged, upper annular packer 420*a* and lower annular packer 420*b* are disengaged and upper sealing element 100*a* and lower sealing element 100*b* are relaxed such that the annulus surrounding drill pipe 330 is unsealed.

Figure 5B:
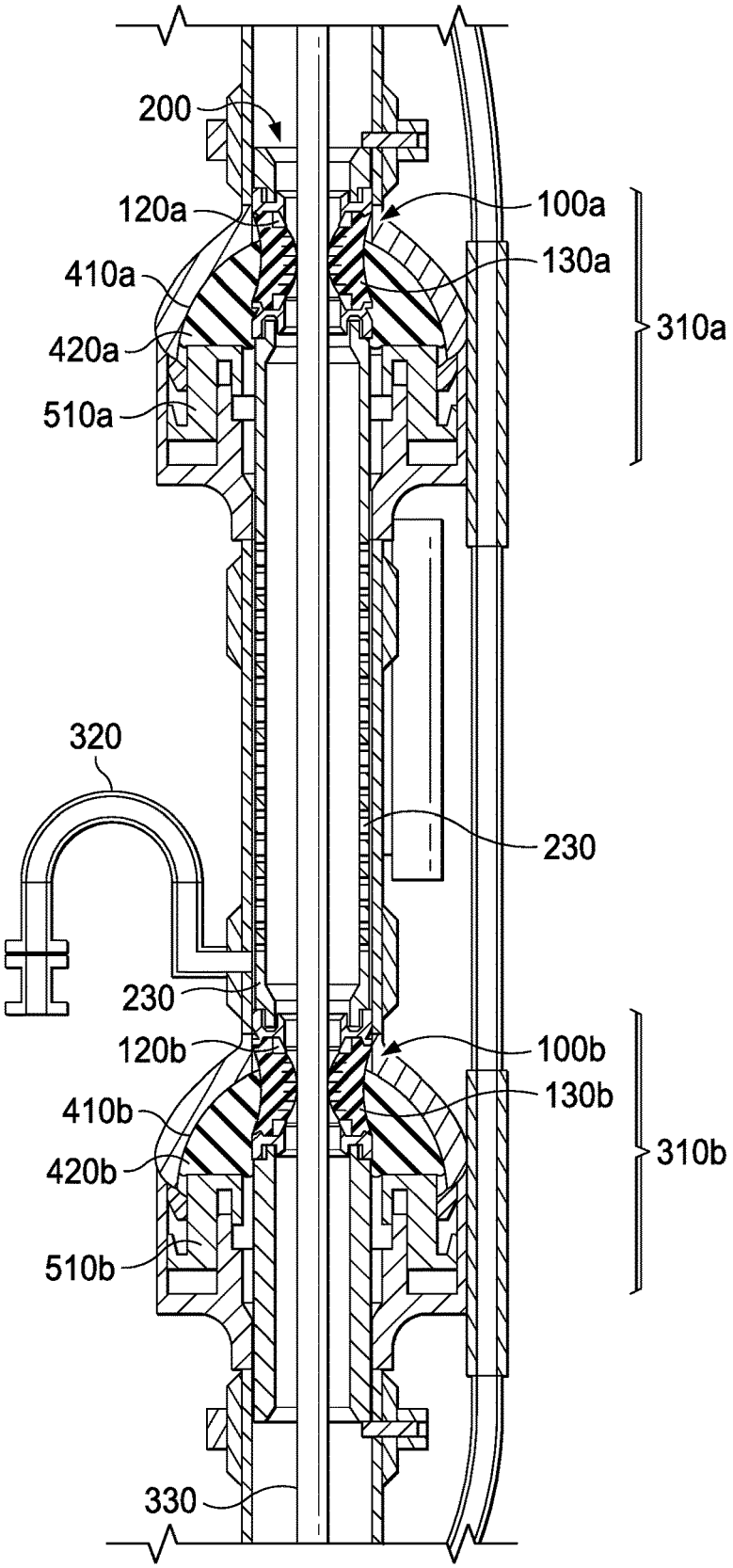
FIG. 5B PRIOR ART
FIG. 5B shows a cross-sectional view of the ACD-type annular sealing system with drill pipe disposed therein with the annular packer systems in an engaged state.

Continuing, FIG. 5B shows a partial cross-sectional view of the ACD-type annular sealing system (e.g., 300 of FIG. 3) with dual seal sleeve 200 and drill pipe 330 disposed therein, where upper annular packer system 310*a* and lower annular packer system 310*b* are in an engaged state. As noted above, while redundant sealing elements 100*a* and 100*b* are typically engaged or disengaged at the same time, upper annular packer system 310*a* and lower annular packer system 310*b* may be driven independent of one another. When upper annular packer system 310*a* is engaged, a hydraulically actuated piston 510*a* travels causing the elastomer or rubber portion of upper annular packer 420*a* to travel within upper radiused housing 410*a*. When sufficiently engaged, upper annular packer 420*a* causes upper sealing element 100*a* to make contact, and form an interference fit with, drill pipe 330. Specifically, the upper seal insert 120*a* and upper buffer material 130*a* make contact and form an interference fit with a circumference of drill pipe 330. Similarly, when lower annular packer system 310*b* is engaged, a hydraulically actuated piston 510*b* travels causing the elastomer or rubber portion of lower annular packer 420*b* to travel within lower radiused housing 410*b*. When sufficiently engaged, lower annular packer 420*b* causes lower sealing element 100*b* to make contact, and form an interference fit with, drill pipe 330. Specifically, lower seal insert 120*b* and lower buffer material 130*b* make contact and form an interference fit with a circumference of drill pipe 330.

Figure 5C:
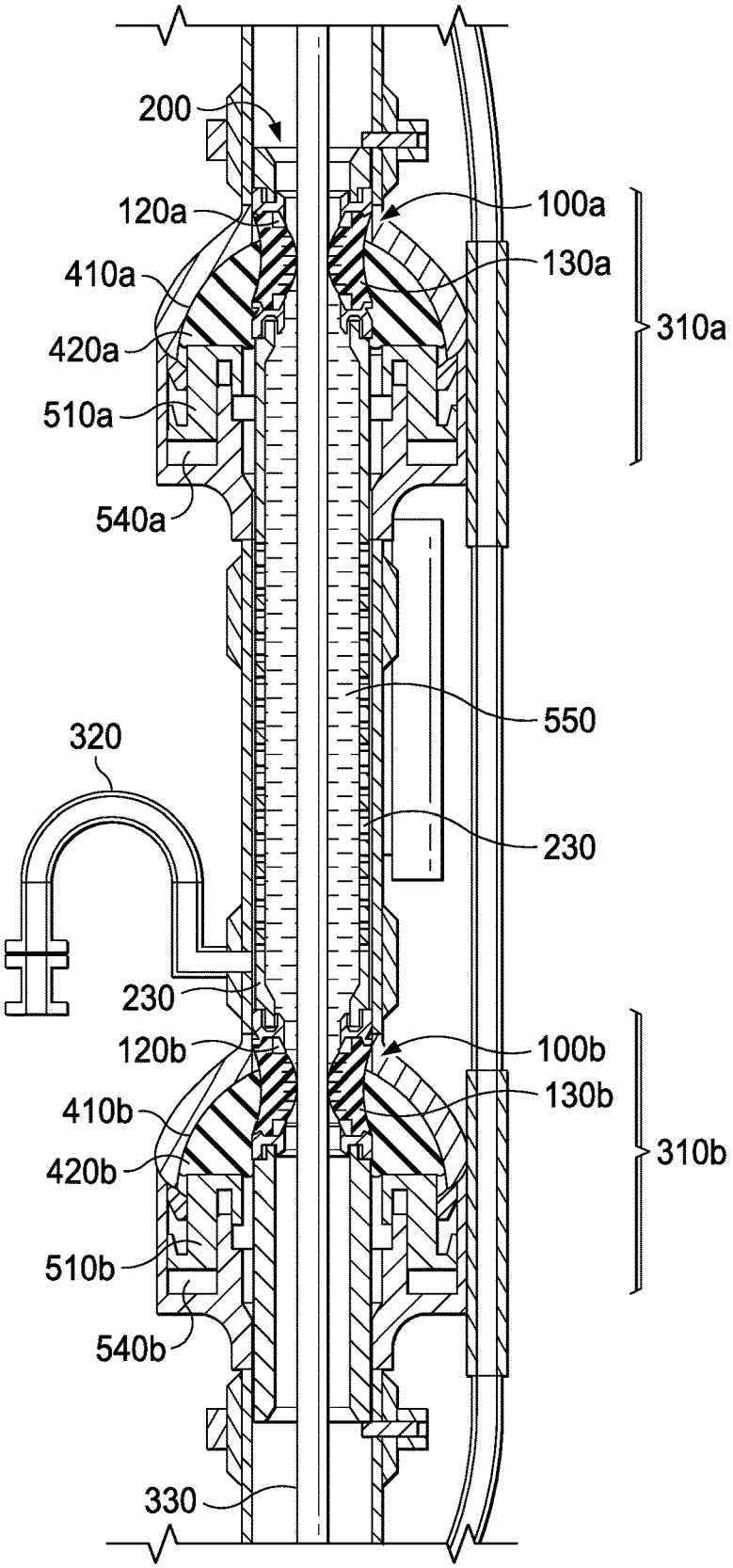
FIG. 5C PRIOR ART
FIG. 5C shows a cross-sectional view of the ACD-type annular sealing system with drill pipe disposed therein with the annular packer systems in an engaged state and lubrication fluid injected into a lubrication chamber.

Continuing, FIG. 5C shows a partial cross-sectional view of the ACD-type annular sealing system (e.g., 300 of FIG. 3) with dual seal sleeve 200 and drill pipe 330 disposed therein, where upper annular packer system 310*a* and lower annular packer system 310*b* are in an engaged state and lubrication is injected into lubrication chamber 550 via a lubrication injection port 320. When drilling ahead, the pressure of lubrication chamber 550 may be maintained just above wellbore pressure by injecting a lubrication fluid 530 that may be comprised of, for example, active drilling mud, into the cavity (not independently illustrated). The hydraulic closing pressures (not shown) of upper annular packer system 310*a* and lower annular packer system 310*b* of the ACD-type annular sealing system (e.g., 300 of FIG. 3), that are configured to engage upper sealing element 100*a* and lower sealing element 100*b* respectively, may be adjusted independently to maintain the desired pressure within lubrication chamber 550. Lubrication fluid 530 cools and lubricates upper sealing element 100*a* and lower sealing element

100*b*. Because of the rotation of the drill pipe 330 and the imperfect seal formed by the sealing elements 100*a* and 100*b*, the injected lubrication fluid 530 that lubricates lower sealing element 100*b* may eventually work its way below lower sealing element 100*b* and join the return flow of fluids (not shown) to the choke manifold (not shown) disposed on the surface (not shown). The lubrication fluid 530 that lubricates upper sealing element 100*a* may be collected in the trip tank (not shown). In one or more embodiments of the present invention, the hydraulic closing pressures (not shown) of upper annular packer system 310*a* and lower annular packer system 310*b* of the ACD-type annular sealing system (e.g., 300 of FIG. 3) may be actively and independently adjusted to maintain the annular seal (not independently illustrated).

After landing dual seal sleeve 200 within ACD-type annular sealing system (e.g., 300 of FIG. 3), an active control system (not shown) may initialize the wellbore seal by engaging upper annular packer 420*a* and lower annular packer 420*b* to engage upper sealing element 100*a* and lower sealing element 100*b*. The active control system (not shown) may inject hydraulic power fluid into upper closing chamber 540*a* and lower closing chamber 540*b* of upper annular packer system 310*a* and lower annular packer system 310*b* respectively and maintain closing pressures for each at the required level to maintain the annular seal. The amount of closing pressure applied to closing chamber 540 directly affects the amount of closing force acting on its respective sealing element 100 to seal the annulus. By varying the closing pressure as a function of the drilling parameters, an optimal closing force may be applied to the sealing elements 100 to ensure a tight seal during critical events and extend the seal life during less intensive operations. The active control system (not shown), enables the ACD-type annular sealing system (e.g., 300 of FIG. 3) to hold wellbore pressure up to the static pressure rating of the system, such as, for example, approximately 2,000 pounds per square inch ("psi") when the drill string is not rotating.

Figure 6A:
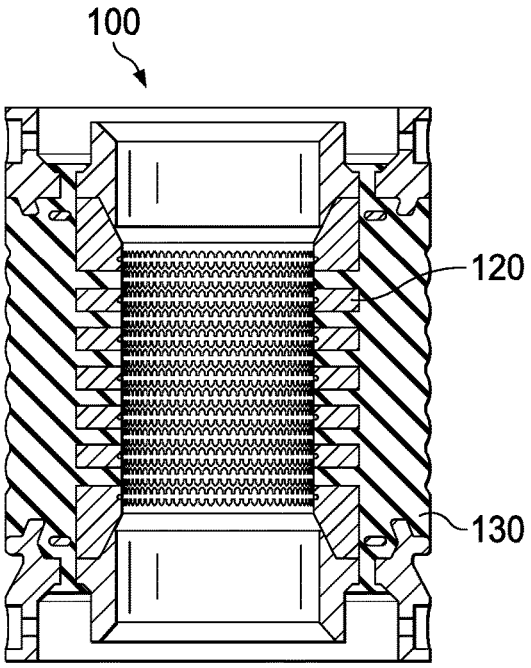
FIG. 6A shows a cross-sectional view of a sealing element of an ACD-type annular sealing system in a new and unworn state in accordance with one or more embodiments of the present invention.
Figure 6B:
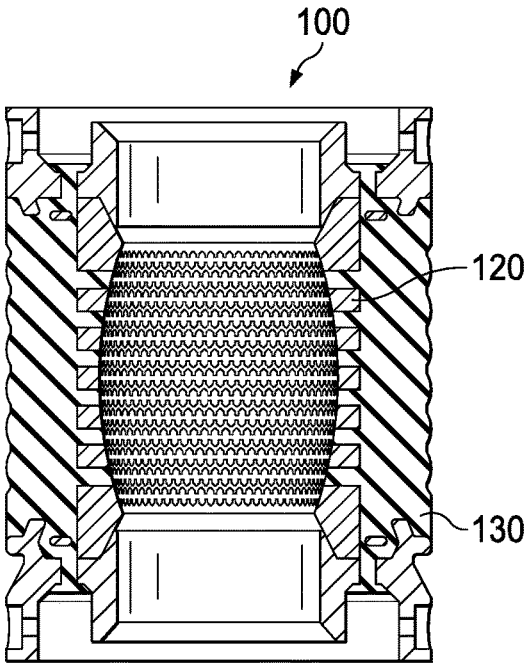
FIG. 6B shows a cross-sectional view of the sealing element of the ACD-type annular sealing system in a partially worn state in accordance with one or more embodiments of the present invention.

FIG. 6A shows a cross-sectional view of a sealing element 100 of an ACD-type annular sealing system (e.g., 300 of FIG. 3) in a new and unworn state in accordance with one or more embodiments of the present invention. Seal insert 120 and buffer material 130 are in a substantially new condition such that, when engaged, seal insert 120 and buffer material 130 make contact, and form an interference fit with, the drill pipe (e.g., 330 of FIG. 5). Continuing, FIG. 6B shows a cross-sectional view of sealing element 100 of the ACD-type annular sealing system (e.g., 300 of FIG. 3) in a partially worn state in accordance with one or more embodiments of the present invention. Over time, due to sustained use, seal insert 120 and buffer material 130 are partially worn such that the shape of the central lumen 610 is bulbous. Consequently, because of the partially worn state of sealing element 100, the annular packer system (e.g., 310 of FIG. 3) may require more hydraulic actuation, to cause the worn sealing element 100 to make sufficient closing contact with the drill pipe (e.g., 330 of FIG. 5) to maintain the annular seal.

Figure 6C:
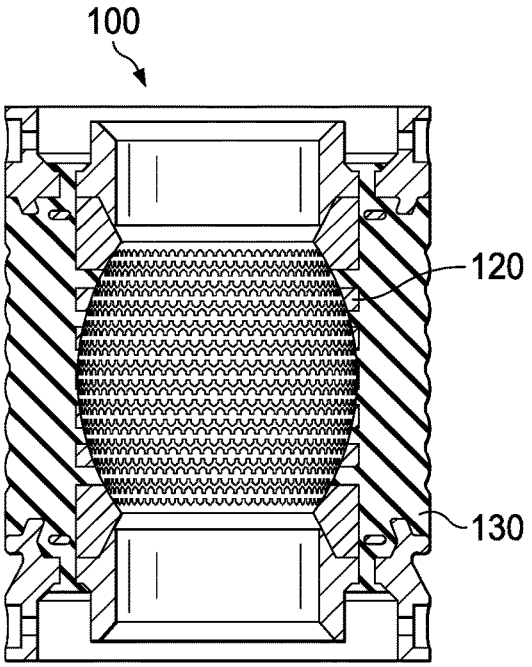
FIG. 6C shows a cross-sectional view of the sealing element of the ACD-type annular sealing system in a substantially worn state in accordance with one or more embodiments of the present invention.
Figure 6D:
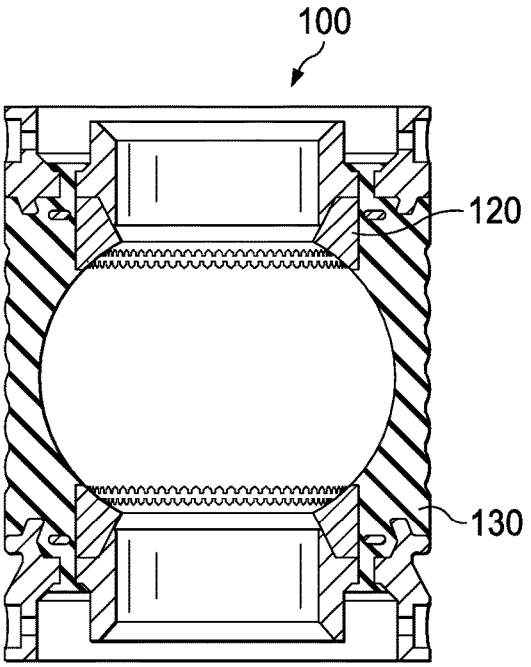
FIG. 6D shows a cross-sectional view of the sealing element of the ACD-type annular sealing system in a fully worn state in accordance with one or more embodiments of the present invention.

Continuing, FIG. 6C shows a cross-sectional view of sealing element 100 of the ACD-type annular sealing system (e.g., 300 of FIG. 3) in a substantially worn state in accordance with one or more embodiments of the present invention. Continued use of the partially worn sealing element 100 causes further wear to seal insert 120 and buffer material 130 such that the shape of the central lumen 610 is even more bulbous. Consequently, because of the substantially worn state of sealing element 100, the annular packer system (e.g., 310 of FIG. 3) may require even more hydraulic actuation, to cause the substantially worn sealing element 100 to make sufficient closing contact with the drill pipe (e.g., 330 of FIG. 5) to maintain the annular seal. Continuing, FIG. 6D shows a cross-sectional view of sealing element 100 of the ACD-type annular sealing system (e.g., 300 of FIG. 3) in a fully worn state in accordance with one or more embodiments of the present invention. Continued use of the substantially worn sealing element 100 causes further wear to seal insert 120 and buffer material 130 such that a substantial portion of seal insert 120 is fully worn away and the central lumen is even more bulbous and consists primarily of buffer material 130. Consequently, because of the fully worn state of sealing element 100, the annular packer system (e.g., 310 of FIG. 3) may require even more hydraulic actuation, if even possible at all, to cause the fully worn sealing element 100 to make sufficient closing contact with the drill pipe (e.g., 330 of FIG. 5) to maintain the annular seal. In such circumstances, buffer material 130 must be relied upon to make the closing contact with the drill pipe (e.g., 330 of FIG. 5) in an attempt to maintain the annular seal. However, buffer material 130 is typically composed of polyurethane and is not wear resistant. While buffer material 130 wears rather quickly with rotation, it likely has a functional life on the order of magnitude of hours that allows the operator to plan replacement of the sealing element 100 at an opportune time.

As discussed above, in the conventional construction of hydrocarbon wells, mud weight is the primary variable used to maintain the correct downhole pressure profile. In conventional drilling applications, the mud weight gradient must be both greater than the pore pressure gradient to prevent an influx under static conditions and less than the fracture pressure gradient to prevent fracturing the formation under dynamic conditions. An excursion of wellbore pressure below the pore pressure may result in an influx of formation fluids into the wellbore. Similarly, exceeding the fracture pressure in one formation may decrease the annular fluid level, resulting in an influx from an offset formation. Further, in conventional drilling, changes to the well pressure profile are made by circulating a new mud density, sometimes requiring hours to completely take effect. As the well progresses deeper, the contributions of dynamic pressures increase. Often, this results in smaller drilling margins and an increased risk of an influx near the end of a hole section.

The deepwater and ultra-deepwater environments present their own unique sets of challenges. Due to the relatively high cost of drilling in deep waters, operators must seek out the most productive wells possible, which typically means drilling in formations with high permeability and porosity. In such formations, maintenance of downhole pressure is critical as a slight drawdown pressure can invite many barrels of formation fluids into the wellbore in a very short amount of time. Detection of kicks can also be more challenging in deep waters. Pit volumizing methods that are reliable on land are less effective when the drilling rig is pitching and rolling in the waves, meaning that significant volumes of formation fluids may enter the well before detection. In the event gas accumulates in the riser above the subsea BOP, a deepwater drilling rig may be forced to divert wellbore fluids overboard to protect the rig and crew from uncontrolled gas expansion.

ASBP-MPD techniques provide a greater level of control over the drilling process compared to conventional drilling practices. By closing the annulus with an annular sealing system and diverting returns through the choke manifold, variable annular surface pressure offsets the dynamic pressure lost during connections. When drilling ahead, the surface pressure and flow rate may be used as a feedback mechanism from the well, indicating the well state. With ASBP-MPD, a lighter mud weight is allowable, enabling drilling in narrower drilling margins. If losses are anticipated, the rig may drill ahead with back pressure greater than atmospheric pressure to allow downward pressure adjustment. Further, in the closed circulation system, flow occurs within a defined volume and may be driven through advanced flow meters, allowing the control system to analyze rate changes in addition to changes in volume accumulations, reducing the time to detect kicks. If a kick is detected, the MPD system may increase the annular pressure, potentially stopping the influx. Variations in the surface pressure affect the downhole pressure as early as the pressure front arrives, reducing the time for deliberate changes to take effect from hours to minutes or seconds. This merging of reduced time to detection and better response actions results in smaller total influx volumes. Smaller influx volumes contain less energy than larger influx volumes, reducing the possibility of damaging weaker formations during kick circulation.

An ACD-type annular sealing system tailored for deepwater and ultra-deepwater MPD applications may use dual American Petroleum Institute ("API") 16A annular packer systems to actuate a non-rotating dual API 16RCD seal sleeve assembly without the use of a bearing assembly. An active control system may be used to adjust control parameters on each sealing element independently of one another, allowing the closing force to be optimized for the current drilling parameters. As a sealing element wears, the active control system maintains seal integrity by keeping contact between the sealing element and the drillpipe. The active control system enables monitoring of the parameters for controlling the seal, facilitating direct monitoring of the sealing element condition. Condition monitoring allows the drilling rig to proactively plan future operations and reduce the occurrence of downtime for reactive maintenance.

In one or more embodiments of the present invention, seal condition monitoring may be implemented through analysis of one or more control parameters, measured values, and modeled values. Sealing element wear may be induced only when the drill string is in motion. As the sealing elements accumulate rotating and stripping hours, as noted above, the seal inserts are gradually worn. While the seal insert is intact, the material properties of the seal insert and the buffer material affect the closing pressure required to create the annular seal. When the seal inserts are worn, only the material properties of the buffer material affect the closing pressure required to create a seal. The result of this difference is applied in the determination of a condition of a sealing element or the determination of a worn sealing element, where a significant change in the closing pressure (as a function of wellbore pressure) changes rapidly for a given wellbore or lubrication chamber pressure. In practice, an indication that a sealing element is worn may alert the crew that a replacement sealing element will be required soon.

An alert may signify that one or more seal inserts are worn but does not imply a failure of the ACD-type annular sealing system to hold wellbore pressure or a failure of one or more sealing elements themselves. In all cases depicted in, for example, FIGS. 6A through 6D, the drill pipe tool joint diameter drifts through the sealing element, which demonstrates that the active control device supplies the closing pressure necessary to create the annular seal, not the geometry of the sealing element. With the purpose of the polymer seal insert being to provide wear resistance, wearing of the seal insert only implies that the available rotating life is limited. In practice, the observance of the seal wear alert serves as a good point to strip to a safe stopping point and start preparing the well for seal sleeve retrieval and replacement operation.

An ACD-type annular sealing system (e.g., 300 of FIG. 3) was used to determine the optimal closing pressure to apply as a function of wellbore pressure and drill pipe rotation rate. The drill mode tests were conducted holding the drill ahead ASBP at 250 psi with a drillpipe rotation rate of 160 revolutions per minute ("rpm").

Figure 7A:
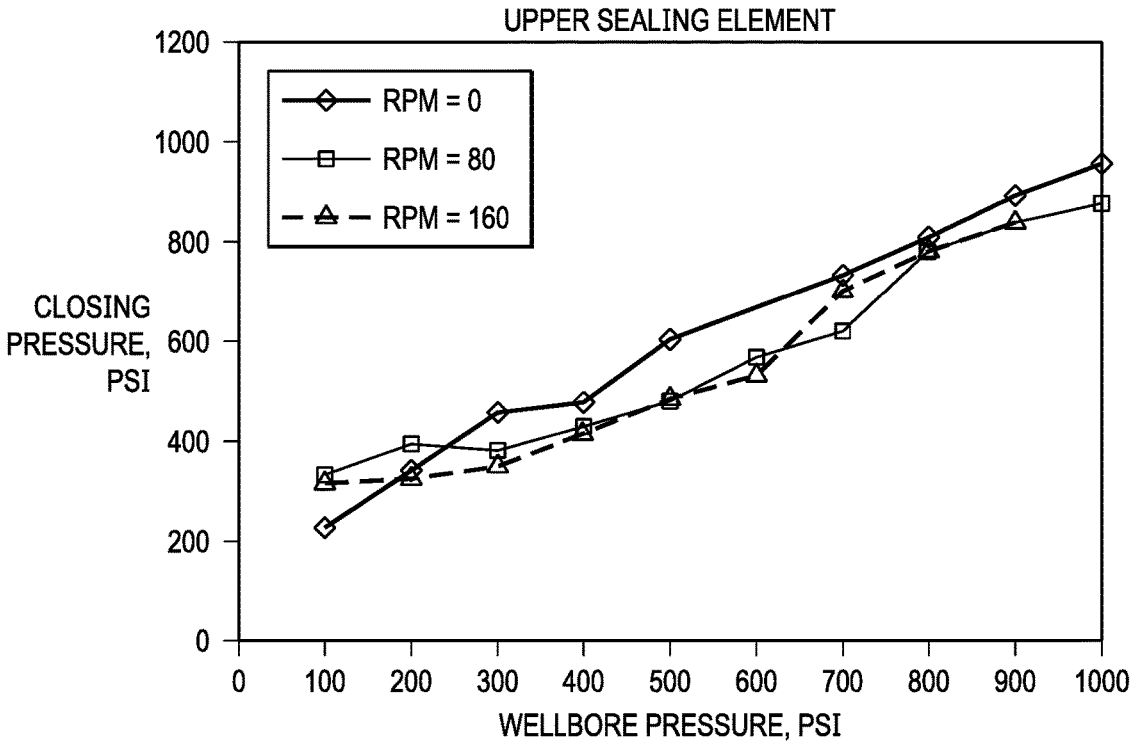
FIG. 7A shows the optimal closing pressure range for the upper annular packer system in accordance with one or more embodiments of the present invention.
Figure 7B:
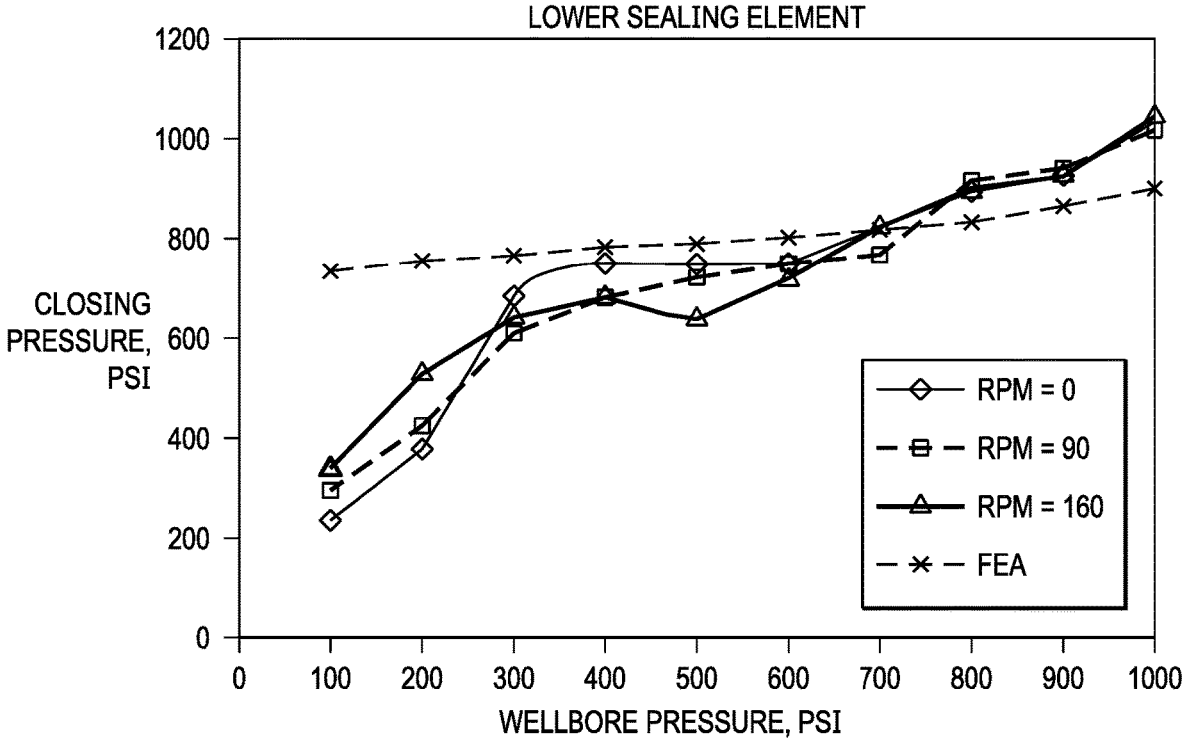
FIG. 7B shows the optimal closing pressure range for the lower annular packer system in accordance with one or more embodiments of the present invention.

FIG. 7A shows the optimal closing pressure range for the upper annular packer system (e.g., 310*a* of FIG. 3) in accordance with one or more embodiments of the present invention. Continuing, FIG. 7B shows the optimal closing pressure range for the lower annular packer system (e.g., 310*b* of FIG. 3) in accordance with one or more embodiments of the present invention. It has been discovered that the upper annular packer system (e.g., 310*a* of FIG. 3) and the lower annular packer system (e.g., 310*b* of FIG. 3) require different closing pressures because of the differential pressures at which each sealing element (i.e., 100*a* versus 100*b*) hold the seal are different. The lubrication chamber (e.g., 550 of FIG. 5C) pressure, the pressure in the chamber in between the upper sealing element (e.g., 100*a* of FIG. 2) and the lower sealing element (e.g., 100*b* of FIG. 2) may be maintained at a pressure somewhat higher than the wellbore pressure to ensure containment of wellbore fluids below the lower sealing element (e.g., 100*b* of FIG. 2). The differential pressure on the lower sealing element (e.g., 100*b* of FIG. 2) may be approximately 50 psi above wellbore pressure, ensuring that any leaked fluid is clean mud leaking down from the lubrication chamber (e.g., 550 of FIG. 5C), rather than wellbore fluids leaking up from the well. The differential pressure on the upper sealing element (e.g., 100*a* of FIG. 2) is the difference between the lubrication chamber (e.g., 550 of FIG. 5C) pressure and the atmosphere.

During drill mode tests with ASBP of 250 psi and drill string rotation rate of 160 rpm, upper closing pressure, lower closing pressure, lubrication pressure, and wellbore pressure were logged. It was noted that closing pressure deflected upward and downward as a tool joint entered and exited the sealing element. This effect is the same as surge flow from an annular packer system as a tool joint passes through the sealing element. Entrance of the tool joint pushes back against the annular packers, temporarily increasing the closing pressure. The active control system adjusts to maintain a constant closing pressure at the set value with the tool joint in the sealing element. The exit of the tool joint allows the annular packer to return to close on the smaller drill pipe body diameter, temporarily decreasing the closing pressure. The active control system adjusts to maintain a constant closing pressure at the set value with the drill pipe body once again in the sealing element.

It was discovered that the state of the upper sealing element seal insert may be determined by decreased lubrication pressure or increased closing pressure required to maintain the seal. Upon detection of the worn upper sealing element seal insert, the drilling rig may continue operations while holding pressure for an additional amount of time until the lower sealing element requires replacement. The amount of time that the rig may operate after detection of a worn seal insert may vary but can be determined as a function of the drilling parameters in effect. In one or more embodiments of the present invention, so long as the lubrication chamber pressure and wellbore pressure are held substantially constant, changes in required closing pressure and their correlation to seal insert wear will follow a predictable signature. The signature may be developed through finite element analysis, empirical data, or combinations thereof.

Figure 8:
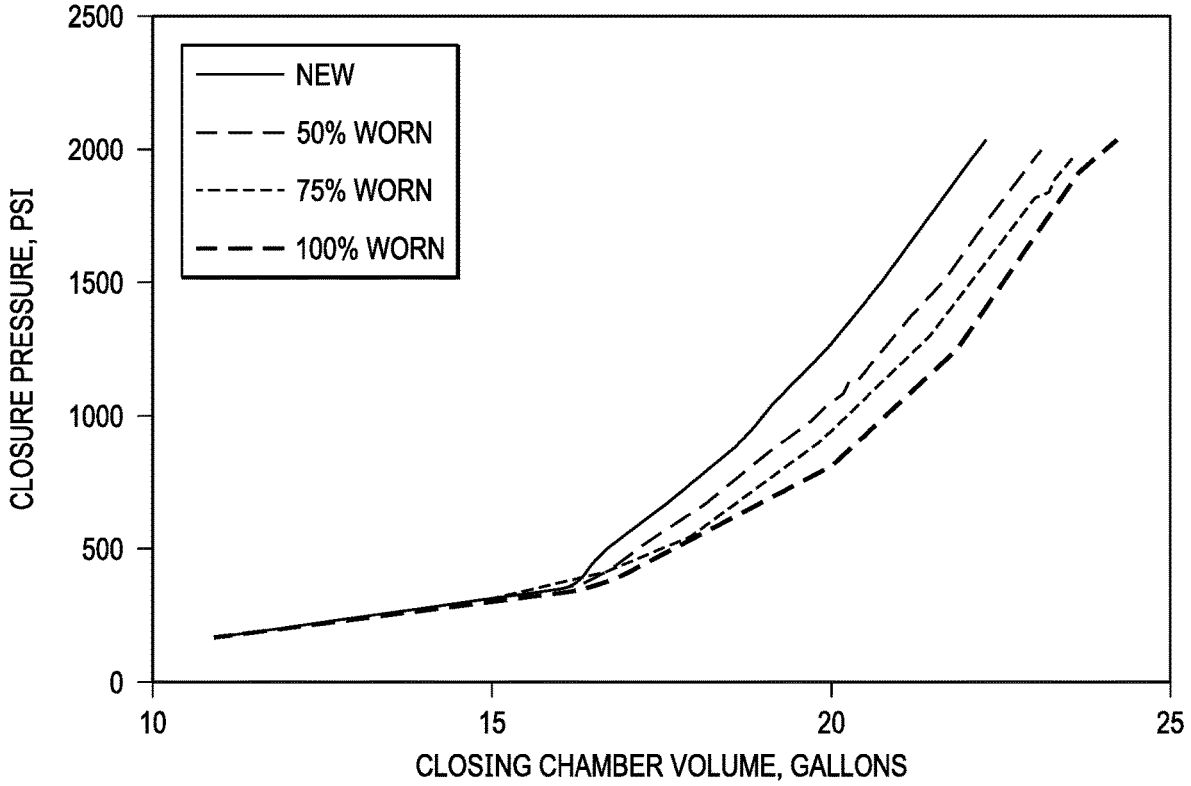
FIG. 8 shows the relationship between closing pressure and closing chamber volume of an annular packer system in accordance with one or more embodiments of the present invention.

FIG. 8 shows the relationship between the closing pressure and the closing chamber volume of an annular packer system (e.g., 310 of FIG. 3) in accordance with one or more embodiments of the present invention. The closing pressure and closing chamber volume are interrelated hydraulic control system variables. A hydraulic power unit provides hydraulic fluid injection into the closing chamber of the annular packer system, thereby increasing closing pressure causing one or more pistons (not shown) of the annular packer system to close on the sealing element when sufficient closing pressure is applied. As the closing force increases, the sealing element deforms and bows inward radially toward the drill pipe, where the seal insert makes contact with the drill pipe (when the seal insert is not entirely worn). The inward bow of the sealing element results in additional piston displacement for a given closing pressure. This results in additional closing chamber volume of the annular packer system. The closing pressure required to create the seal is a function of the wellbore pressure and the sealing element material properties. As the geometry of the sealing element changes (i.e., as shown in FIGS. 6A through 6D) from the slow wear of sealing element material volume, primarily of the seal insert, but also the buffer material. Over the course of the life of a sealing element, rotation of the drill string within the non-rotating sealing element reduces the wall thickness of the seal insert. The reduction in seal insert thickness reduces the volume of the sealing element. The reduction in volume of the sealing element volume is offset by increasing the closing chamber volume for a given closing pressure and wellbore pressure. A sequence for condition monitoring may be formed when a closing pressure and closing chamber volume necessary to maintain the annular seal at a given wellbore pressure is applied to indicate the amount of sealing element material remaining. The relationship between the closing pressure, the closing chamber volume, and the wear state of the sealing element, specifically the seal insert, may be determined as shown in FIG. 8.

With an established relationship between the closing pressure, the closing chamber volume, and condition of the sealing element, analysis of these variables provides actionable information to the drilling rig. Monitoring the closing chamber volume and closing pressure may provide the amount of sealing element wear without having to stop operations and retrieve the sealing element from the ACD-type annular sealing system. It has been discovered through empirical test results, finite element analysis, and modeling that the relationship between the closing pressure and the lubrication chamber pressure may also be used to determine when a sealing element requires replacement. When the seal insert is intact, the closing pressure and the lubrication chamber pressure remain steady. As the seal insert wears from use, its component to the seal integrity is removed, resulting in decreased lubrication chamber pressure.

In one or more embodiments of the present invention, a method of seal condition monitoring for an ACD-type annular sealing system may include engaging an upper annular packer system to engage an upper sealing element to form an upper interference fit that seals an annulus surrounding a drill pipe. The upper annular packer system may include a piston-actuated upper annular packer that is configured to travel within the spherical housing of the upper annular packer system, exerting a closing force on the upper sealing element. Because the upper sealing element is composed of a seal insert co-molded with a buffer material, the closing force causes the upper sealing element to bow inward radially, forming the interference fit with the drill pipe. As noted above, the upper sealing element remains stationary as the drill pipe rotates. Over time, the seal insert of the upper sealing element may wear, such that additional closing pressure may be required to maintain the annular seal. An active control system may determine the upper closing pressure required for the upper annular packer of the upper annular packer system to sufficiently close on the upper sealing element to form the upper interference fit. The determination may be made based on the ability of the lubrication chamber to hold pressure and the direction that lubrication fluids flow. During drilling operations, the active control system may actively adjust the upper closing pressure to maintain the upper interference fit. In this context, actively means on an ongoing basis during drilling operations and includes any adjustment period including continuous real-time adjustment or adjustment at predetermined intervals of time. In certain embodiments, if a change in the upper closing pressure required to maintain the upper interference fit exceeds a predetermined amount over a predetermined period of time, an alert may be provided to an operator via a display of the active control system indicating that the upper sealing element is worn. In other embodiments, if a change in the upper closing pressure required to maintain the upper interference fit exceeds a predetermined amount over a predetermined period of time, the active control system may take actions such as, for example, scheduling or halting drilling operations. In essence, the delta in closing pressure, the amount and period of which may vary based on an application or design, signifies that the seal insert has worn and that the interference fit may be maintained by the buffer material alone, which is not wear resistant and will wear rather quickly. As such, the delta detected doesn't necessarily mean the sealing element has failed, just that it doesn't have much longer until it does fail. The period that drilling may be extended under such circumstances is typically on the order of magnitude of hours. The predetermined amount and the predetermined period of time may be determined in advance by modeling, measurement, or analysis of empirical results for a given annular sealing system and sealing element.

Similarly, the method may include engaging a lower annular packer system to engage a lower sealing element to form a lower interference fit that seals the annulus surrounding the drill pipe (below the seal created by the upper sealing element). The lower annular packer system may include a piston-actuated lower annular packer that is configured to travel within the spherical housing of the lower annular packer system, exerting a closing force on the lower sealing element. Because the lower sealing element is composed of a seal insert co-molded with a buffer material, the closing force causes the lower sealing element to bow inward radially, forming the interference fit with the drill pipe. As noted above, the lower sealing element remains stationary as the drill pipe rotates. Over time, the seal insert of the lower sealing element may wear, such that additional closing pressure may be required to maintain the annular seal. The active control system may determine the lower closing pressure required for the lower annular packer of the lower annular packer system to sufficiently close on the lower sealing element to form the lower interference fit. The determination may be made based on the ability of the lubrication chamber to hold pressure and the direction that lubrication fluids flow. During drilling operations, the active control system may actively adjust the lower closing pressure to maintain the lower interference fit. In certain embodiments, if a change in the lower closing pressure required to maintain the lower interference fit exceeds a predetermined amount over a predetermined period of time, an alert may be provided to the operator via a display of the active control system indicating that the lower sealing element is worn. In other embodiments, if a change in the lower closing pressure required to maintain the lower interference fit exceeds a predetermined amount over a predetermined period of time, the active control system may take actions such as, for example, scheduling or halting drilling operations.

When the upper sealing element and the lower sealing element are engaged, there is a lubrication chamber pressure in the lubrication chamber bounded by the upper sealing element and the lower sealing element. A lubrication injection port may inject lubrication fluids into the lubrication chamber and a relief valve may be used to relieve pressure in the lubrication chamber should it be required. Typically, the lubrication chamber pressure is maintained at a pressure somewhat higher than the wellbore pressure to ensure that leaks of injected lubrication fluid leak down.

In one or more embodiments of the present invention, a method of seal condition monitoring for an ACD-type annular sealing system may include stopping drilling operations, if any, and engaging a drill string isolation tool, or equivalent thereof, to seal the annulus surrounding a drill pipe. The method may include disengaging the upper annular packer system to disengage the upper sealing element to unseal the annulus surrounding the drill pipe and disengaging the lower annular packer system to disengage the lower sealing element to unseal the annulus surrounding the drill pipe. Once the annular seal is being maintained by the drill string isolation tool, or equivalent thereof, and the ACD-type annular sealing system is disengaged, an upper flow meter of a hydraulic power unit may be tared. The hydraulic power unit may be configured to provide hydraulic power to one or more upper actuating pistons of an upper annular packer system. Then the upper annular packer system may be engaged to engage the upper sealing element to close on the drill pipe up to a predetermined upper calibration pressure. In certain embodiments, the predetermined upper calibration pressure may be 2,000 psi. However, one of ordinary skill in the art, having the benefit of this disclosure will recognize that the predetermined upper calibration pressure may vary based on an application or design in accordance with one or more embodiments of the present invention. The predetermined upper calibration pressure may represent the maximum amount of upper closing pressure capable of being applied. The upper flow meter may be monitored to determine an upper closing chamber volume for a predetermined period of time. The predetermined period of time may include any period up to and including the entire run time after calibration. The condition of the upper sealing element may be determined based on a predetermined relationship, such as that shown in, for example, FIG. 8, between the upper closing chamber volume and an extent to which the upper sealing element is worn. The extent may be determined by empirical data, statistical analysis, or modeling. An active control system may provide the operator with an indication of the extent to which the upper sealing element is worn based on the determined condition, such indication may be displayed on a display of the active controls system.

Similarly, a lower flow meter of the hydraulic power unit may be tared. The hydraulic power unit may be configured to provide hydraulic power to one or more upper actuating pistons of a lower annular packer system. Then the lower annular packer system may be engaged to engage the lower sealing element to close on the drill pipe up to a predetermined lower calibration pressure. In certain embodiments, the predetermined lower calibration pressure may be 2,000 psi. However, one of ordinary skill in the art, having the benefit of this disclosure will recognize that the predetermined lower calibration pressure may vary based on an application or design in accordance with one or more embodiments of the present invention. The predetermined upper calibration pressure may represent the maximum amount of upper closing pressure capable of being applied. The lower flow meter may be monitored to determine an lower closing chamber volume for a predetermined period of time. The predetermined period of time may include any period up to and including the entire run time after calibration. The condition of the lower sealing element may be determined based on a predetermined relationship, such as that shown in, for example, FIG. 8, between the lower closing chamber volume and an extent to which the lower sealing element is worn. The extent may be determined by empirical data, statistical analysis, or modeling. The active control system may provide the operator with an indication of the extent to which the lower sealing element is worn based on the determined condition, such indication may be displayed on a display of the active controls system.

In one or more embodiments of the present invention, a method of seal condition monitoring for an ACD-type annular sealing system may include generating modeled data including one or more of a modeled upper closing pressure of an upper annular packer of an upper annular packer system, a modeled wellbore pressure, and a modeled lubrication chamber pressure of the annular sealing system for anticipated drilling operations and conditions. Measured data may be input including one or more of a measured upper closing pressure of the upper annular packer of the upper annular packer system, a measured wellbore pressure, and a measured lubrication chamber pressure of the annular sealing system for drilling operations and conditions. The measured data may be compared with the modeled data to determine a condition of the upper sealing element. In certain embodiments, the active control system may provide the operator with the condition of the upper sealing element such that appropriate action may be taken. The condition may be provided via a display of the active control system. In other embodiments, the active control system may take appropriate action based on the condition of the upper sealing element.

Similarly, modeled data may be generated including one or more of a modeled lower closing pressure of a lower annular packer of an lower annular packer system, a modeled wellbore pressure, and a modeled lubrication chamber pressure of the annular sealing system for anticipated drilling operations and conditions. Measured data may be input including one or more of a measured lower closing pressure of the lower annular packer of the lower annular packer system, a measured wellbore pressure, and a measured lubrication chamber pressure of the annular sealing system for drilling operations and conditions. The measured data may be compared with the modeled data to determine a condition of the lower sealing element. In certain embodiments, the active control system may provide the operator with the condition of the lower sealing element such that appropriate action may be taken. The condition may be provided via a display of the active control system. In other embodiments, the active control system may take appropriate action based on the condition of the lower sealing element.

In one or more embodiments of the present invention, a system for seal condition monitoring may include an ACD-type annular sealing system and an active control system. The ACD-type annular sealing system may include an upper annular packer system having a piston-actuated upper annular packer configured to engage an upper sealing element to close on a drill pipe to form an upper interference fit that seals the annulus surrounding the drill pipe. The lower annular packer system may include a piston-actuated lower annular packer configured to engage a lower sealing element to close on the drill pipe to form a lower interference fit that seals the annulus surrounding the drill pipe. A lubrication chamber may be disposed in between the upper annular packer system and the lower annular packer system that includes a lubrication injection port and a pressure relief valve. The active control system may provide the operator with one or more of a condition of the upper sealing element and the lower sealing element or an indication of the extent to which the upper sealing element and the lower sealing element are worn. In certain embodiments, the system may include a hydraulic power unit that includes an upper annular packer hydraulic power line and a lower annular packer hydraulic power line. The upper annular packer hydraulic power line provides hydraulic power to actuate the upper annular packer piston and the lower annular packer hydraulic power line provides hydraulic power to actuate the lower annular packer piston. In certain embodiments, the system may include an upper flow meter may be configured to measure a hydraulic injection fluid flow in the upper annular packer hydraulic power line and a lower flow meter configured to measure the hydraulic injection fluid flow in the lower annular packer hydraulic power line. In certain embodiments, the system may include a wellbore pressure measurement device configured to measure wellbore pressure. The active control system may determine the lubrication chamber pressure, the upper annular packer closing pressure, and the lower annular packer closing pressure.

Figure 9:
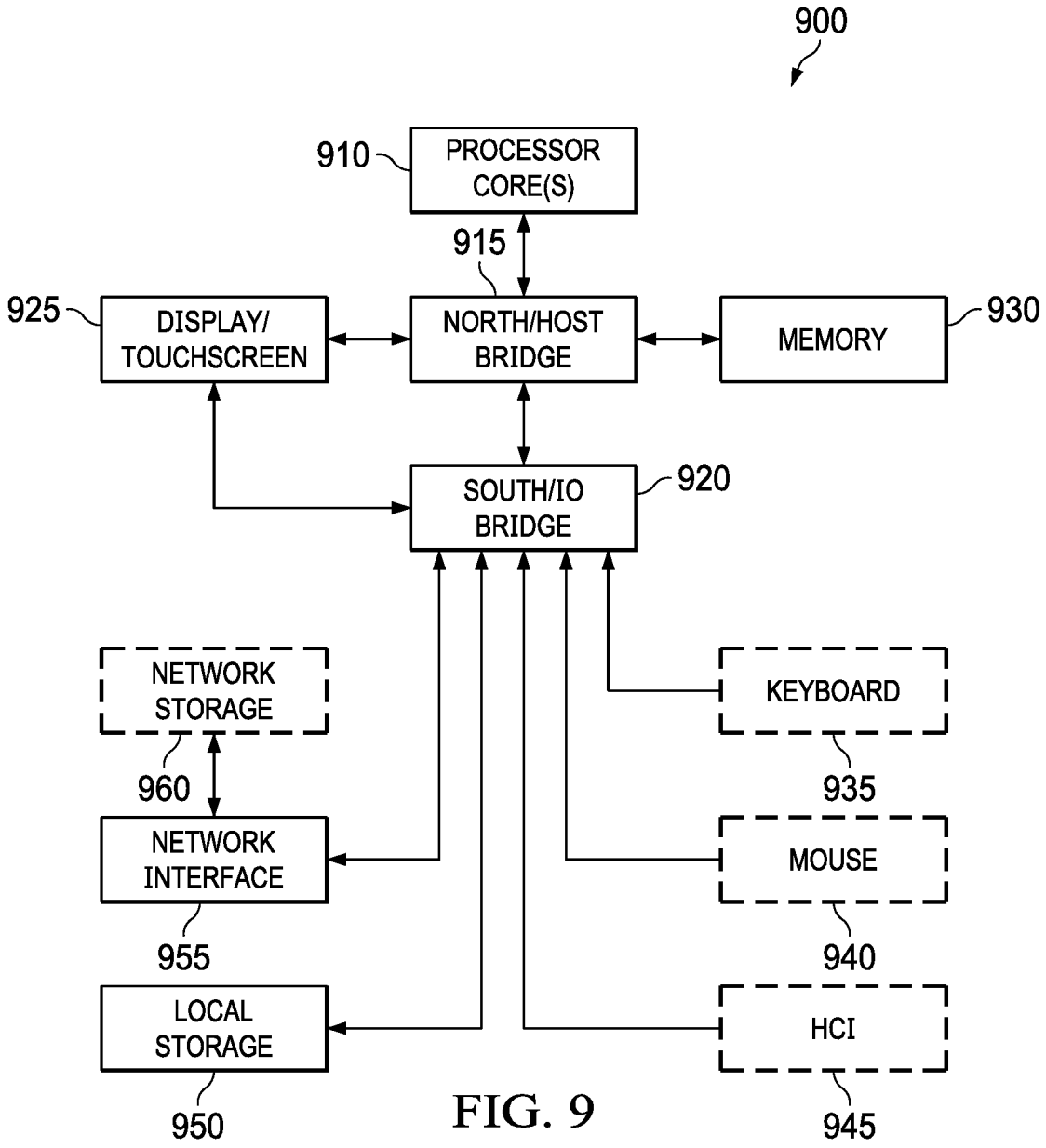
FIG. 9 shows an active control system in accordance with one or more embodiments of the present invention.

FIG. 9 shows an active control system 900 in accordance with one or more embodiments of the present invention. accordance with one or more embodiments of the present invention.

Active control system 900 may be used to control all aspects of the operation of the ACD-type annular sealing system (e.g., 300 of FIG. 3) including, for example, one or more of the upper closing pressure to the upper annular packer system, the lower closing pressure to the lower annular packer system, and the lubrication chamber pressure of the lubrication chamber. Active control system 900 may control such things through control of the hydraulic power unit (not shown), the lubrication fluid injection flow rate, and the lubrication chamber (e.g., 550 of FIG. 5C) relief valve. Active control system 900 may also monitor measured properties including, for example, one or more of measured flow rates of hydraulic power fluid to the upper annular packer system, measured flow rates of hydraulic power fluid to the lower annular packer system, measured wellbore pressure, measured flow rates of injected lubrication fluid, measured lubrication chamber pressure. Active control system 900 may also perform all modeling, correlation, comparison, and data analysis used as part of a system for seal condition monitoring.

Active control system 900 may include one or more processor cores 910 disposed on one or more printed circuit boards (not shown). Each of the one or more processor cores 910 may be a single-core processor (not independently illustrated) or a multi-core processor (not independently illustrated). Multi-core processors typically include a plurality of processor cores disposed on the same physical die (not shown) or a plurality of processor cores disposed on multiple die (not shown) that are collectively disposed within the same mechanical package. Active control system 900 may also include various core logic components such as, for example, a north, or host, bridge device 915 and a south, or input/output ("IO"), bridge device 920. North bridge 915 may include one or more processor interface(s), memory interface(s), graphics interface(s), high speed TO interface(s) (not shown), and south bridge interface(s). South bridge 920 may include one or more TO interface(s). One of ordinary skill in the art will recognize that the one or more processor cores 910, north bridge 915, and south bridge 920, or various subsets or combinations of functions or features thereof, may be integrated, in whole or in part, or distributed among various discrete devices, in a way that may vary based on an application, design, or form factor in accordance with one or more embodiments of the present invention.

Active control system 900 may include one or more TO devices such as, for example, a display device 925, system memory 930, optional keyboard 935, optional mouse 940, and/or an optional human-computer interface 945. Depending on the application or design of active control system 900, the one or more TO devices may or may not be integrated. Display device 925 may be a touch screen that includes a touch sensor (not independently illustrated) configured to sense touch. For example, a user may interact directly with objects depicted on display device 925 by touch or gestures that are sensed by the touch sensor and treated as input by active control system 900.

Active control system 900 may include one or more local storage devices 950. Local storage device 950 may be a solid-state memory device, a solid-state memory device array, a hard disk drive, a hard disk drive array, or any other non-transitory computer readable medium. Active control system 900 may include one or more network interface devices 955 that provide one or more network interfaces. The network interface may be Ethernet, Wi-Fi, Bluetooth, WiMAX, Fibre Channel, or any other network interface suitable to facilitate networked communications.

Active control system 900 may include one or more network-attached storage devices 960 in addition to, or instead of, one or more local storage devices 950. Network-attached storage device 960 may be a solid-state memory device, a solid-state memory device array, a hard disk drive, a hard disk drive array, or any other non-transitory computer readable medium. Network-attached storage device 960 may or may not be collocated with active control system 900 and may be accessible to active control system 900 via one or more network interfaces provided by one or more network interface devices 955.

One of ordinary skill in the art will recognize that active control system 900 may be a cloud-based server, a server, a workstation, a desktop, a laptop, a netbook, a tablet, a smartphone, a mobile device, and/or any other type of computing system in accordance with one or more embodiments of the present invention. Moreover, one of ordinary skill in the art will recognize that active control system 900 may be any other type or kind of system based on programmable logic controllers ("PLC"), programmable logic devices ("PLD"), or any other type or kind of system, including combinations thereof, capable of inputting data, performing calculations, and outputting control signals that manipulate a smart choke manifold. In addition, the functions performed by active control system 900 may be incorporated into one or more pre-existing computer systems disposed on the drilling rig and instrumented in a similar manner.

Advantages of one or more embodiments of the present invention may include, but is not limited to, one or more of the following:

In one or more embodiments of the present invention, a method of seal condition monitoring provides advance notice of the state of the annular seal, the condition of one or more sealing elements, takes actions to maintain the annular seal as one or more sealing elements transition from a new condition to a worn condition, and provide advance notice of the impending failure of one or more sealing elements so as to avoid a potentially catastrophic annular seal failure while the marine riser is pressurized.

In one or more embodiments of the present invention, a method of seal condition monitoring provides proactive rather than reactive monitoring of the condition of the one or more sealing elements. The one or more sealing elements may be replaced well in advance of failure, but potentially later than a conventional maintenance schedule approach would otherwise dictate.

In one or more embodiments of the present invention, a method of seal condition monitoring allows one or more worn sealing elements to be proactively replaced without depressurizing the marine riser and prior to seal failure.

In one or more embodiments of the present invention, a method of seal condition monitoring allows the replacement of one or more sealing elements to be planned in advance and coordinated with other rig operations to improve the efficiency of operations and maintain the safety of the drilling rig and personnel.

In one or more embodiments of the present invention, a method of seal condition monitoring extends the usable life of the sealing elements beyond a conventional maintenance schedule and allows for their replacement in advance of their failure, but at a time typically much later than the conventional maintenance schedule would dictate.

In one or more embodiments of the present invention, a method of seal condition monitoring reduces or eliminates costs associated with inspection, removal, and replacement of sealing elements as inspections are no longer required and removal and replacement are done well in advance of failure and at a time that is convenient for drilling operations and the operator.

In one or more embodiments of the present invention, a method of seal condition monitoring improves the safety of operations by providing the driller with actionable information about the state of one or more sealing elements.

In one or more embodiments of the present invention, a method of seal condition monitoring improves the safety of operations by proactively monitoring and avoiding catastrophic seal failure.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of seal condition monitoring for an annular sealing system comprising:

engaging an upper annular packer system to engage an upper sealing element to form an upper interference fit that seals an annulus surrounding a drill pipe;

determining an upper closing pressure required for an upper annular packer of the upper annular packer system to sufficiently close on the upper sealing element to form the upper interference fit;

during drilling operations, actively adjusting the upper closing pressure to maintain the upper interference fit; and if a change in the upper closing pressure required to maintain the upper interference fit exceeds a predetermined amount over a predetermined period of time, providing an alert indicating that the upper sealing element is worn, wherein the upper sealing element comprises an upper seal insert co-molded with an upper buffer material.

2. The method of seal condition monitoring of claim 1, further comprising:

engaging a lower annular packer system to engage a lower sealing element to form a lower interference fit that seals the annulus surrounding the drill pipe;

determining a lower closing pressure required for a lower annular packer of the lower annular packer system to sufficiently close on the lower sealing element to form the lower interference fit;

during drilling operations, actively adjusting the lower closing pressure to maintain the lower interference fit; and if a change in the lower closing pressure required to maintain the lower interference fit exceeds a predetermined amount over a predetermined period of time, providing an alert indicating that the lower sealing element is worn.

3. The method of seal condition monitoring of claim 2, wherein the lower sealing element comprises a lower seal insert co-molded with a lower buffer material.

4. The method of seal condition monitoring of claim 3, wherein the lower seal insert comprises polytetrafluoroethylene, ultra-high molecular weight polyethylene, or other polymer-based material.

5. The method of seal condition monitoring of claim 3, wherein the lower buffer material comprises polyurethane, nitrile, acrylonitrile butadiene rubber, hydrogenated acrylonitrile butadiene rubber, or other elastomer material.

6. The method of seal condition monitoring of claim 3, wherein the lower seal insert comprises a honeycomb or matrix pattern that provides wear resistance when contact is made with the drill pipe as it rotates.

7. The method of seal condition monitoring of claim 1, further comprising:

maintaining a lubrication chamber pressure higher than a wellbore pressure.

8. The method of seal condition monitoring of claim 1, wherein the upper seal insert comprises polytetrafluoroethylene, ultra-high molecular weight polyethylene, or other polymer-based material.

9. The method of seal condition monitoring of claim 1, wherein the upper buffer material comprises polyurethane, nitrile, acrylonitrile butadiene rubber, hydrogenated acrylonitrile butadiene rubber, or other elastomer material.

10. The method of seal condition monitoring of claim 1, wherein the upper seal insert comprises a honeycomb or matrix pattern that provides wear resistance when contact is made with the drill pipe as it rotates.

11. A method of seal condition monitoring for an annular sealing system comprising:

taring an upper flow meter of a hydraulic power unit configured to provide hydraulic power to one or more upper actuating pistons of an upper annular packer system;

engaging the upper annular packer system to engage an upper sealing element to close on a drill pipe up to a predetermined upper calibration pressure;

monitoring the upper flow meter to determine an upper closing chamber volume for a predetermined period of time;

determining a condition of the upper sealing element based on a predetermined relationship between the upper closing chamber volume and an extent to which the upper sealing element is worn; and providing an indication of the extent to which the upper sealing element is worn based on the determined condition.

12. The method of seal condition monitoring of claim 11, further comprising:

taring a lower flow meter of the hydraulic power unit configured to provide hydraulic power to one or more lower actuating pistons of a lower annular packer system;

engaging the lower annular packer system to engage a lower sealing element to close on the drill pipe up to a predetermined lower calibration pressure;

monitoring the lower flow meter to determine a lower closing chamber volume for the predetermined period of time;

determining a condition of the lower sealing element based on a predetermined relationship between the lower closing chamber volume and an extent to which the lower sealing element is worn; and providing an indication of the extent to which the lower sealing element is worn based on the determined condition.

13. The method of seal condition monitoring of claim 12, further comprising:

stopping drilling operations;

engaging a drill string isolation tool to seal an annulus surrounding the drill pipe;

disengaging the upper annular packer system to disengage the upper sealing element to unseal the annulus surrounding the drill pipe; and disengaging the lower annular packer system to disengage the lower sealing element to unseal the annulus surrounding the drill pipe.

14. The method of seal condition monitoring of claim 12, wherein the lower sealing element comprises a lower seal insert co-molded with a lower buffer material.

15. The method of seal condition monitoring of claim 14, wherein the lower seal insert comprises polytetrafluoroethylene, ultra-high molecular weight polyethylene, or other polymer-based material.

16. The method of seal condition monitoring of claim 14, wherein the lower buffer material comprises polyurethane, nitrile, acrylonitrile butadiene rubber, hydrogenated acrylonitrile butadiene rubber, or other elastomer material.

17. The method of seal condition monitoring of claim 14, wherein the lower seal insert comprises a honeycomb or matrix pattern that provides wear resistance when contact is made with the drill pipe as it rotates.

18. The method of seal condition monitoring of claim 11, further comprising:

maintaining a lubrication chamber pressure higher than a wellbore pressure.

19. The method of seal condition monitoring of claim 12, wherein the upper sealing element comprises an upper seal insert co-molded with an upper buffer material.

20. The method of seal condition monitoring of claim 19, wherein the upper seal insert comprises polytetrafluoroethylene, ultra-high molecular weight polyethylene, or other polymer-based material.

21. The method of seal condition monitoring of claim 19, wherein the upper buffer material comprises polyurethane, nitrile, acrylonitrile butadiene rubber, hydrogenated acrylonitrile butadiene rubber, or other elastomer material.

22. The method of seal condition monitoring of claim 19, wherein the upper seal insert comprises a honeycomb or matrix pattern that provides wear resistance when contact is made with the drill pipe as it rotates.

* * * * *